US006394192B1

(12) United States Patent
Frazer

(10) Patent No.: US 6,394,192 B1
(45) Date of Patent: May 28, 2002

(54) METHODS FOR SEABED PISTON CORING

(75) Inventor: Hugh Ivo Frazer, Lower Portland (AU)

(73) Assignee: Benthic GeoTech Pty Ltd, Bondi Junction (AU)

( * ) Notice: Subject to any disclaimer, the term of this patent is extended or adjusted under 35 U.S.C. 154(b) by 0 days.

(21) Appl. No.: 09/485,777

(22) PCT Filed: Aug. 13, 1998

(86) PCT No.: PCT/AU98/00639

§ 371 (c)(1),
(2), (4) Date: Feb. 15, 2000

(87) PCT Pub. No.: WO99/09294

PCT Pub. Date: Feb. 25, 1999

(30) Foreign Application Priority Data

Aug. 15, 1997 (AU) ..... P0 8571

(51) Int. Cl.[7] ..... E21B 25/18
(52) U.S. Cl. ..... 175/58; 175/20; 175/250
(58) Field of Search ..... 175/6, 20, 58–60, 175/250; 166/358, 264

(56) References Cited

U.S. PATENT DOCUMENTS

| | | | | |
|---|---|---|---|---|
| 3,306,110 A | | 2/1967 | Woods | |
| 3,412,814 A | | 11/1968 | Rosfelder | |
| 3,429,388 A | | 2/1969 | Nesteroff et al. | |
| 3,434,551 A | | 3/1969 | Rosfelder | |
| 3,438,452 A | | 4/1969 | Sampling | |
| 3,741,320 A | | 6/1973 | Hilfing | |
| 4,043,407 A | | 8/1977 | Wilkins | |
| 4,234,046 A | | 11/1980 | Haynes | |
| 4,466,487 A | * | 8/1984 | Taylor, Jr. | 166/339 |
| 5,831,185 A | * | 11/1998 | Maxwell et al. | 73/864.45 |

FOREIGN PATENT DOCUMENTS

| | | | |
|---|---|---|---|
| GB | 2142363 | | 1/1985 |
| GB | 2218441 | | 11/1989 |
| JP | 4185892 A | * | 7/1992 |

OTHER PUBLICATIONS

Don Poly, "Subsea core sampler with vibro drive—uses rod and piston with valves, seals and shoulders for backflush assisted barrel penetration", 84–119310/19 (Russian 1033–703–A) (Aug. 1983).

* cited by examiner

*Primary Examiner*—David Bagnell
*Assistant Examiner*—Zakiya Walker
(74) *Attorney, Agent, or Firm*—William H. Dippert; Cowan, Liebowitz & Latman P.C.

(57) ABSTRACT

A method of acquiring a core sample of seabed material into a core sampling tube having an upper end, a lower open end and a substantially cylindrical chamber extending therebetween, comprising the steps of urging the core sampling tube into the seabed and simultaneously withdrawing fluid from the upper end of the core sampling tube at a rate sufficient to cause the seabed material to be drawn into the core tube at substantially the same rate as the core tube penetrates the seabed.

16 Claims, 22 Drawing Sheets

METHODS FOR SEABED PISTON CORING

FIELD OF THE INVENTION

The invention relates to technology used for taking core samples from the seabed using a drill that is lowered and controlled remotely from a ship.

BACKGROUND OF THE INVENTION

Conventionally taking core samples from the seabed has been achieved by either a technique known as piston coring or diamond coring.

Diamond coring is achieved by using conventional core barrels with diamond set bits. Commonly this technique is used when drilling rock.

On the other hand piston coring is particularly suited to seabed operations where typically the seabed is covered with a layer of sedimentary material that is too soft to core successfully using standard diamond coring system.

The current invention relates to improvements in this latter method and therefore the following description deals in detail with that type of prior system.

It is well known to take short samples with core sampling tubes such as the Shelby tube However, it has been found that the friction on the sample acting on the inner walls of the tube quickly builds up to prevent the entry of new material. This means that the tube becomes effectively a solid rod and displaces the sediment without any further winning of sample.

This effect is particularly damaging when there are layers of very soft and harder material, as the friction of the harder material prevents any, or at most little, of the soft material entering the tube. The sample in the tube then consists almost entirely of the harder material.

Other conventional sampling techniques for the seabed take advantage of the water pressure at depth to take longer and more representative samples by use of tethered piston coring technology. In such technology the drill frame located near the seabed by support means and includes a hydraulic feed cylinder and rope and pulley system. The feed cylinder causes the core sampling tube to be pushed into the seabed. A piston is installed inside the sampling tube and includes seals to prevent leakage past the piston. The piston is supported from the frame by tether rope, so that, as the tube is pushed into the seabed, the piston is constrained to remain stationary.

If the friction of the material in the tube creates enough force to overcome the hardness of the material entering the bottom of the tube, the material in the barrel will try to move down with the tube. Providing that the material is essentially impervious, this will create a reduced pressure under the tethered piston. The difference in pressure between that at the bottom of the tube and that under the piston is then available as an additional force to overcome the friction of the material in the tube.

The reduced pressure under the piston is self-regulating as it is generated by the friction in the tube and the pressure gradient down the tube is proportional to the friction in each part of the tube. This means that a complete sample of the seabed is obtained, complete with soft and hard layers.

It will be apparent that this process becomes more effective with increasing water depth because the available reduction in pressure increases. It is essentially ineffective on or near the surface.

Whilst this system is effective, it has been difficult to apply this method to a drill that has a segmented drill string made up of a variable number of drill rods depending on penetration depth, because there is no practical way of connecting the tether rope to the piston in the core barrel at the bottom of the drill string.

Accordingly further investigations have been carried out in attempt to improve the applicability of a piston based coring system.

OBJECT OF THE INVENTION

It is an object of the present invention to overcome the limitations of current piston coring systems, more particularly, to obviate the need to use a structurally tethered piston.

SUMMARY OF THE INVENTION

Accordingly in one aspect of the invention, a method of acquiring a core sample of seabed material into a core sampling tube having an upper end, a lower open end and a substantially cylindrical chamber extending there between, comprising the steps of urging the core sampling tube into the seabed and simultaneously withdrawing fluid from the upper end of the core sampling tube at a rate sufficient to cause the seabed material to be drawn into the core tube at substantially the same rate as the core tube penetrates the seabed.

Preferably, the step of withdrawing fluid from the upper end of the core sample tube comprises withdrawing the fluid through a conduit means connected at one end to the core sampling tube and connected at its other end to a remote means for withdrawing fluid. Preferably, the steps of urging the core sample into the seabed and withdrawing fluid from above the seabed material is performed by a combination of remotely coordinated hydraulic fluid power means. Typically, the coordination of the hydraulic fluid power means comprises the steps of pumping hydraulic fluid into a first hydraulic means to urge the core sampling tube into the seabed and simultaneously pumping hydraulic fluid into a second hydraulic means to withdraw fluid from the upper end of the core sampling tube.

It will be understood that a freely movable piston may or may not be located in the core sampling tube. It will be included where there is a significant risk that seabed material may also be withdrawn from the sampling tube.

Accordingly, it is preferred to provide the core sampling tube further with a piston sealingly engaging and movable within the cylindrical chamber above the seabed material entering the core tube, and the step of withdrawing fluid is from above the piston such that the piston is maintained substantially stationary.

In a separate aspect of the invention which is adapted to be used with the method described above, a core sampling tube is provided comprising a core barrel having an upper end with a fluid inlet/outlet, an open lower end and a substantially cylindrical chamber extending there between to receive seabed material.

Preferably, the core sampling tube further comprises a piston sealingly engaging the cylindrical chamber and movable axially within the cylindrical chamber in response to fluid flow through the inlet/outlet.

Preferably, the core sampling tube further comprises an adaptation at the upper end to provide sealing means to permit a leak free connection to the conduit connectable between the core sampling tube and the remote means for withdrawing fluid.

In a further separate aspect of the invention which is adapted to be used with the method and core sampling tube described above, a seabed coring system is provided comprising:

(a) a core sampling tube described above;

(b) first hydraulic fluid power means to urge the core sampling tube into the seabed;

(c) second hydraulic fluid power means to withdraw fluid from the core sampling tube above the seabed material; and (d) first conduit means connected between the core sampling tube and the second hydraulic fluid power means; wherein the first hydraulic fluid power means and the second hydraulic fluid power means are coordinated such that the seabed material will enter the core sampling tube at substantially the same rate as the core tube penetrates the seabed.

Preferably, the seabed coring system further comprises a piston,sealingly engaging and movable within the cylindrical chamber of the core sampling tube above the seabed material entering the core tube.

Preferably, the first hydraulic fluid power means comprises a substantially cylindrical chamber, a piston sealingly engaging the cylindrical chamber and movable axially within the cylindrical chamber to define a first chamber and a second chamber, and a piston rod connected to the piston and extending through and from the second chamber so that selective application of hydraulic pressure to the first chamber will urge the core sampling tube into the seabed.

Preferably, the second hydraulic fluid power means comprises:

(a) a first sub hydraulic means including a substantially cylindrical chamber, a piston sealingly engaging the cylindrical chamber and movable axially within the cylindrical chamber to define a third chamber and a fourth chamber, a piston rod connected to the piston at one end thereof and extending through the fourth chamber;

(b) a second sub hydraulic means comprising a substantially cylindrical chamber, a piston sealingly engaging the cylindrical chamber and movable axially within the cylindrical chamber to define a fifth chamber, the piston rod of the first sub hydraulic means having its other end connected to the piston; and (c) second conduit means connected between the second chamber of the first hydraulic means and the fourth chamber of the first sub hydraulic means;

wherein, as the core sampling tube is urged into the seabed by the first hydraulic fluid power means, hydraulic fluid is passed from the second chamber of the first hydraulic fluid power means into the fourth chamber of the first sub hydraulic means via the second conduit means to move the piston therein which in turn draws the piston of the second sub hydraulic means away from the first conduit means to cause the withdrawal of fluid from the core sampling tube.

Typically, the first conduit means consists in part of at least one hose with high collapse capability.

In another typical arrangement, the first conduit means consists in part of at least one drill rod with sealing means to provide a leak free joint between the drill rod and any preceding drill rod.

It will be appreciated that three separate aspects of the invention have been disclosed. namely, a method of acquiring a core sample from a seabed, a core sampling tube and a system (apparatus) for acquiring a core sample. Whilst the description explains preferred embodiments of each aspect in combination with one another, such aspects are not so interdependent and should not be so construed.

DESCRIPTION OF THE DRAWINGS

The invention will now be further illustrated with reference to the accompanying drawings in which.

Geological samples on land are often obtained using core drills, typically with diamond tipped drill bits. Similar drill rigs can be mounted on ships and used to take core samples from the seabed, but with greater difficulty as ships move with the sea surface and the water can be very deep. The drill string has to go through the water column before reaching the seabed. The provision of a ship of adequate size capable of holding position with sufficient accuracy adds considerably to the cost.

In recent years, drills capable of sitting on the seabed have been developed as they provide a more stable drilling platform and can be used with a less sophisticated and cheaper ships.

Figure 1:
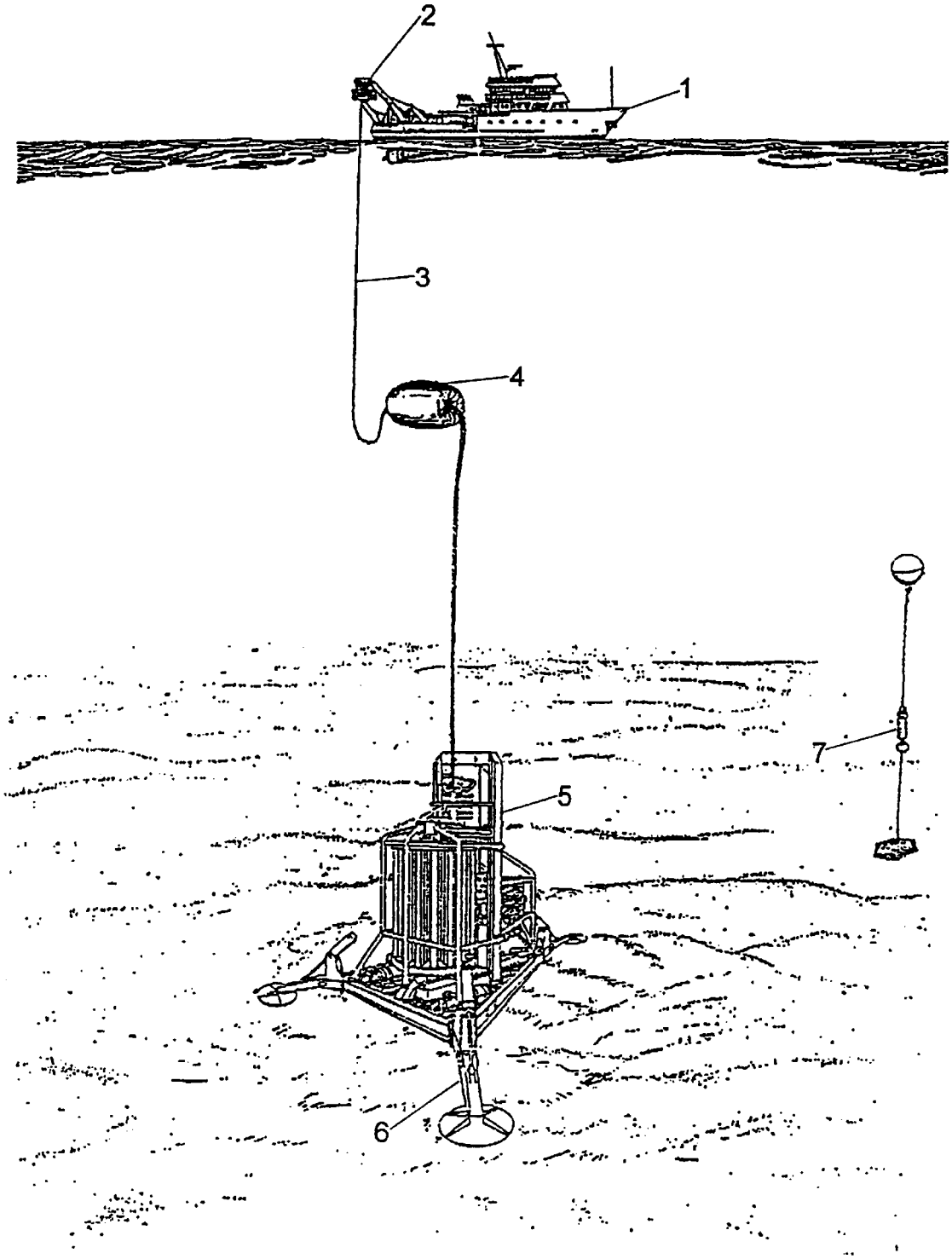
FIG. 1 is an embodiment of a type of drill useable with the invention.

FIG. 1 shows a typical deployment of a seabed drill. A suitable ship 1-1 has carried the drill to the site, swung it over the stem using an A-frame 1-2 and lowered it to the seabed with a winch mounted on the deck of the ship.

The drill is powered by one or more electric motors driving hydraulic pumps so that all mechanical operations are carried out hydraulically through the use of hydraulic motors, rotary actuators and cylinders as appropriate. The drill is remotely controlled from the ship as it is usually deployed in water depths beyond those accessible to a diver. Essential functions are monitored with appropriate remote sensing devices such as pressure switches, pressure transducers and proximity sensors. Undersea video cameras are used to provide visual feed-back.

The cable 1-3 is preferably of a multi-purpose type with steel outer layers to provide the required lifting capability and covering electrical conductors to provide the power for the drill and a fibre-optic core for control and telemetry. However, it is possible to use a normal wire cable for lifting, with power and communications achieved by a separate bundle of cables, typically incorporating floats along its length to achieve neutral or slightly positive buoyancy.

The float 1-4 holds any cable slack away from the drill and acts to isolate the drill from movement of the ship due to sea swell and waves.

The drill itself 1-5 sits firmly on the seabed under the action of its own weight on legs 1-6, possibly assisted by suction feet. Details of the drill construction will be discussed late in this specification.

The location of the drill is established by reference to acoustic transponders mounted on the drill on the ship and on marker buoys 1-7. Acoustic receivers on the drill and on the ship provide triangulated positioning information.

The following description is of a particular design of drill of the seabed type, but it will be understood that the invention is not limited to use with such types of drills.

The basic operation is that the drill is lowered to the seabed with enough empty sampling tools to acquire the penetration desired, typically less than 100 m, and with sufficient drill rods to place the sampling tools to depth, and sufficient casing to hold the hole open as each sampling tool is removed and stored back on the drill. The drill can be loaded with different combinations of several types of sampling and ground testing tools, drill rod and casings to suit the particular conditions of the seabed being investigated.

Typically, the drill tools are 3 m long, giving a total drill height of around 5 m with a total weight of about 7 tonne.

Figures 2A, 2B:
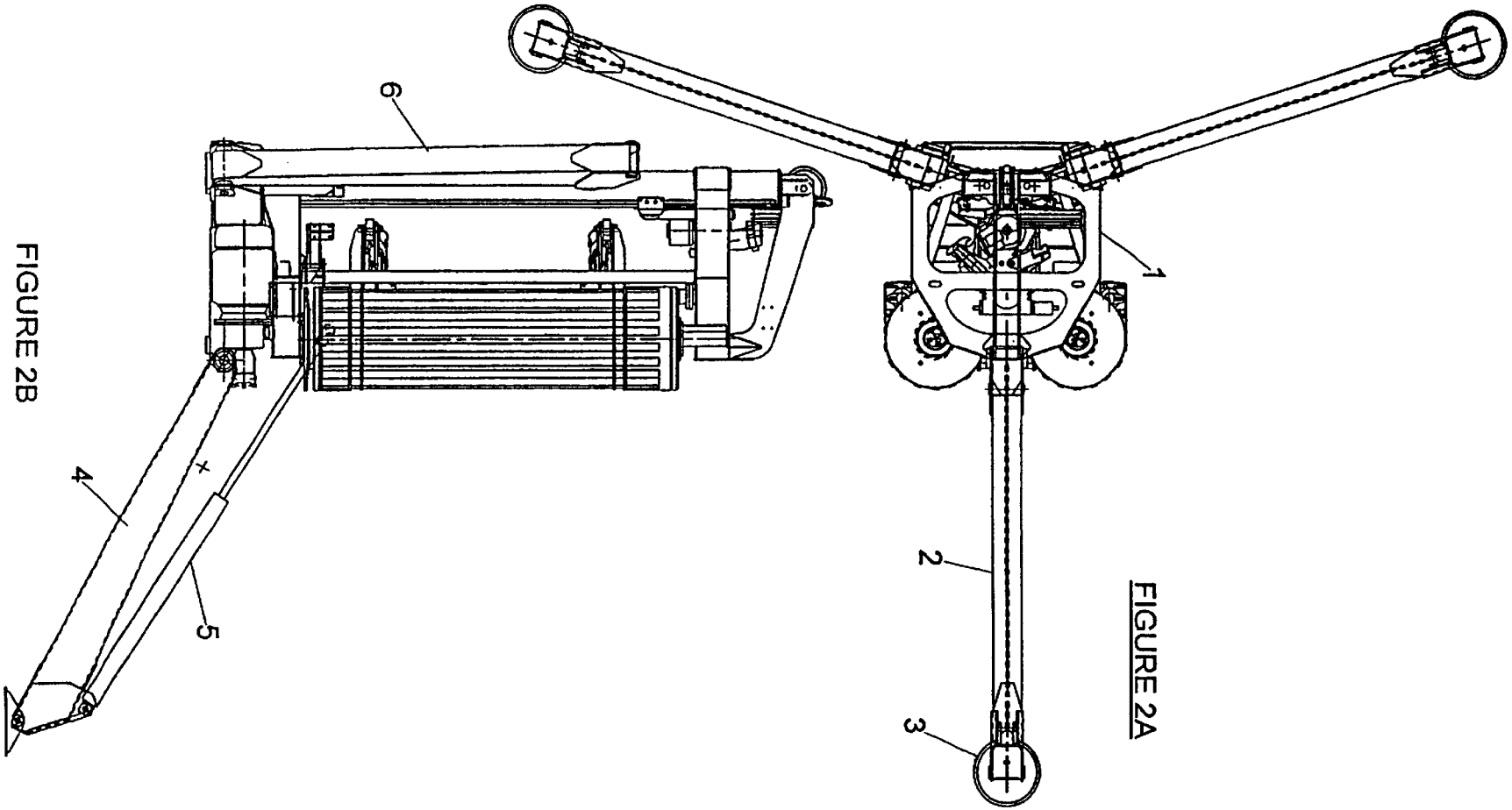
FIG. 2A is a plan view of a drill useable with the invention.
FIG. 2B is a side view of the drill of FIG. 2A.

FIGS. 2A and 2B shows a plan view at the top, and side elevation of a seabed drill consisting of the main body of the drill 2-1 and three legs 2-2 with feet 2-3. The elevation shows one leg 24 fully extended by hydraulic cylinder 2-5 and another leg 2-6 fully retracted to its stowed position and with its foot removed.

The legs are retracted to stowed position for lifting on and off the ship, and the feet are removed for transport from ship to ship. The feet can be made in the form of suction cans and connected to a source of reduced water pressure, such as the suction of a water pump, effectively sucking the feet onto the bottom, to provide a positive hold-down for the drill so that its stability may be increased beyond that obtained from its own weight in water.

Figure 3:
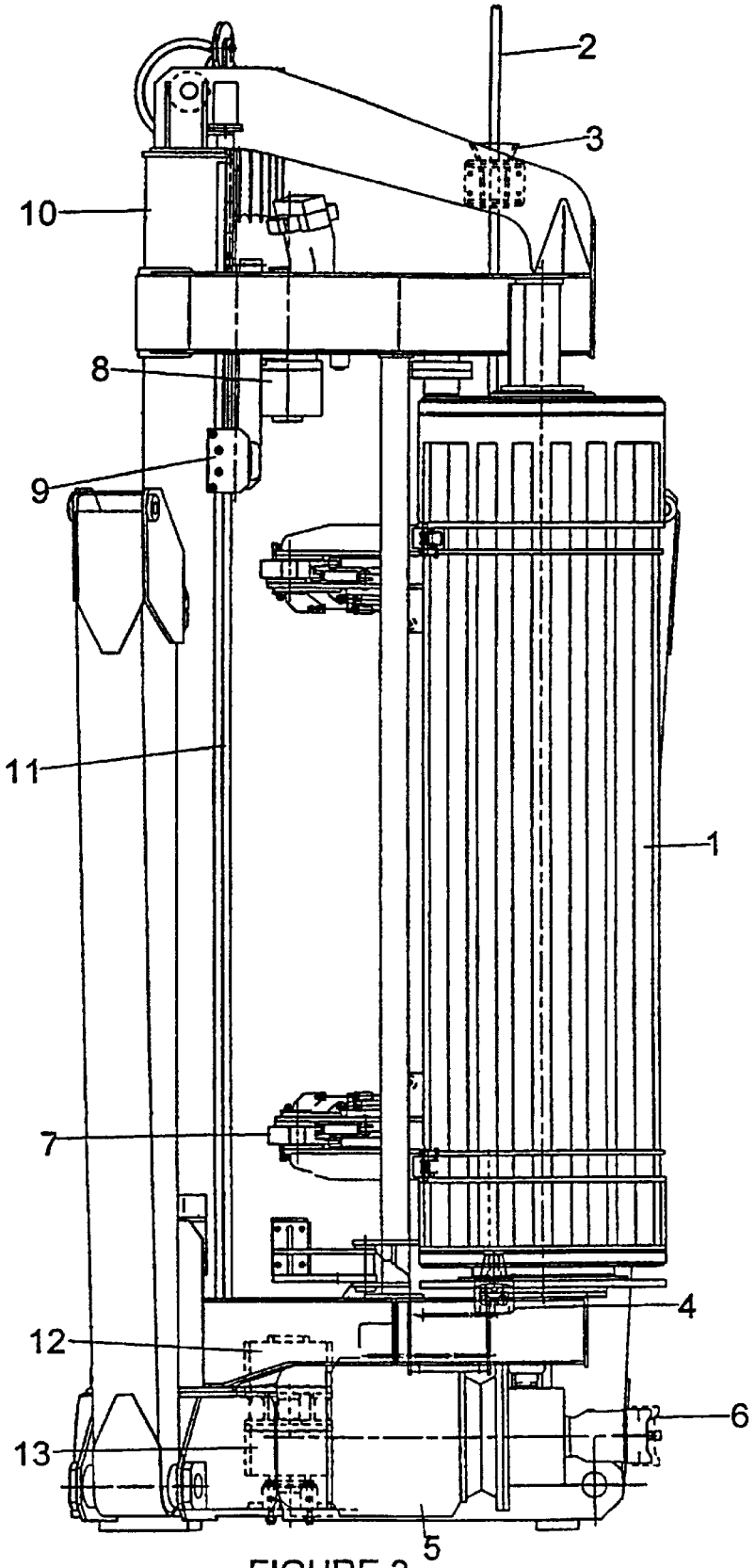
FIG. 3 is a more detailed side view of the drill of FIG. 2A.

FIG. 3 shows a more detailed side elevation of the drill, illustrating many of its main components. This drill is designed for penetration depths of 100 m and requires that the drilling tools be stored in rotary magazines 3-1. In this case there are two magazines, one normally used for core barrels and a second for drill rods and casing. Simpler drills for very shallow penetration may have only a single drill tool and require no storage.

The multi-purpose lift/power/control cable 3-2 passes through a top guide 3-3 to an anchor point 3-4 at the drill base. The power conductors, not shown, are connected to electric motors 3-5 which drive hydraulic pumps 3-6 which power all the mechanical functions of the drill through hydraulic control valves and actuators not shown.

Drilling tools are picked up from the magazines by loading arms 3-7 and presented to the drilling centre line, where they are picked up by the rotary drilling unit 3-8 which is mounted on vertically sliding carriage 3-9. The rotary drilling unit is described in more id detail later. The carriage is moved up and down the elevator mast 3-10 on slides 3-11 by a hydraulic cylinder with a 2:1 rope and sheave system not shown.

A rod clamp 3-12 and casing clamp 3-13 are mounted in the base frame.

Figure 4:
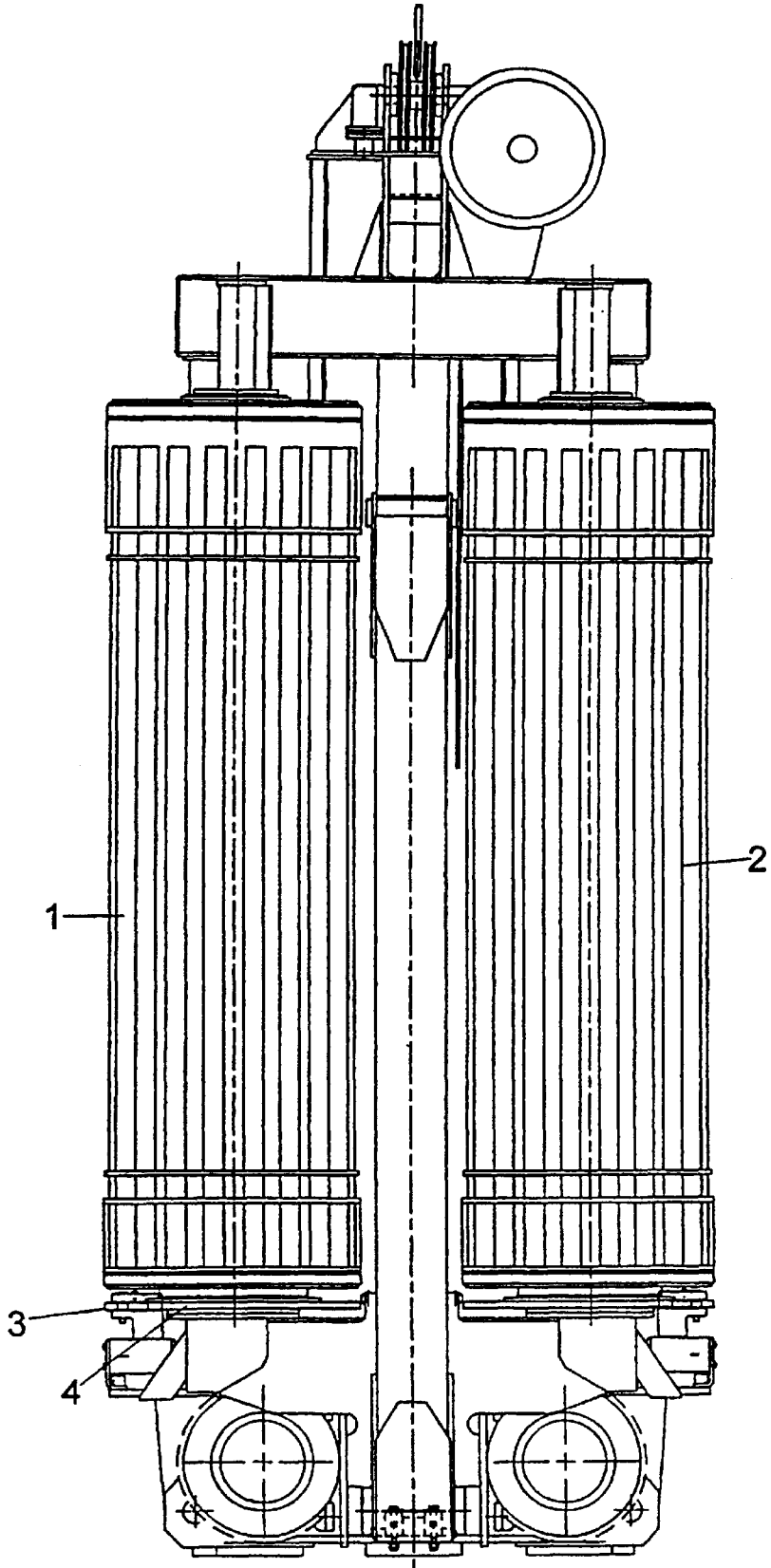
FIG. 4 is an end view of the drill of FIG. 2A.

FIG. 4 shows an end elevation of the drill. This view shows that this drill design has two storage magazines, 4-1 and 4-2, and that each is rotated by a Geneva wheel pinion 4-3. The Geneva wheels themselves 4-4 are not shown in plan, but have the same number of slots as the magazine, see later, so that each full rotation of the pinion advances the magazine one complete slot.

Figure 5:
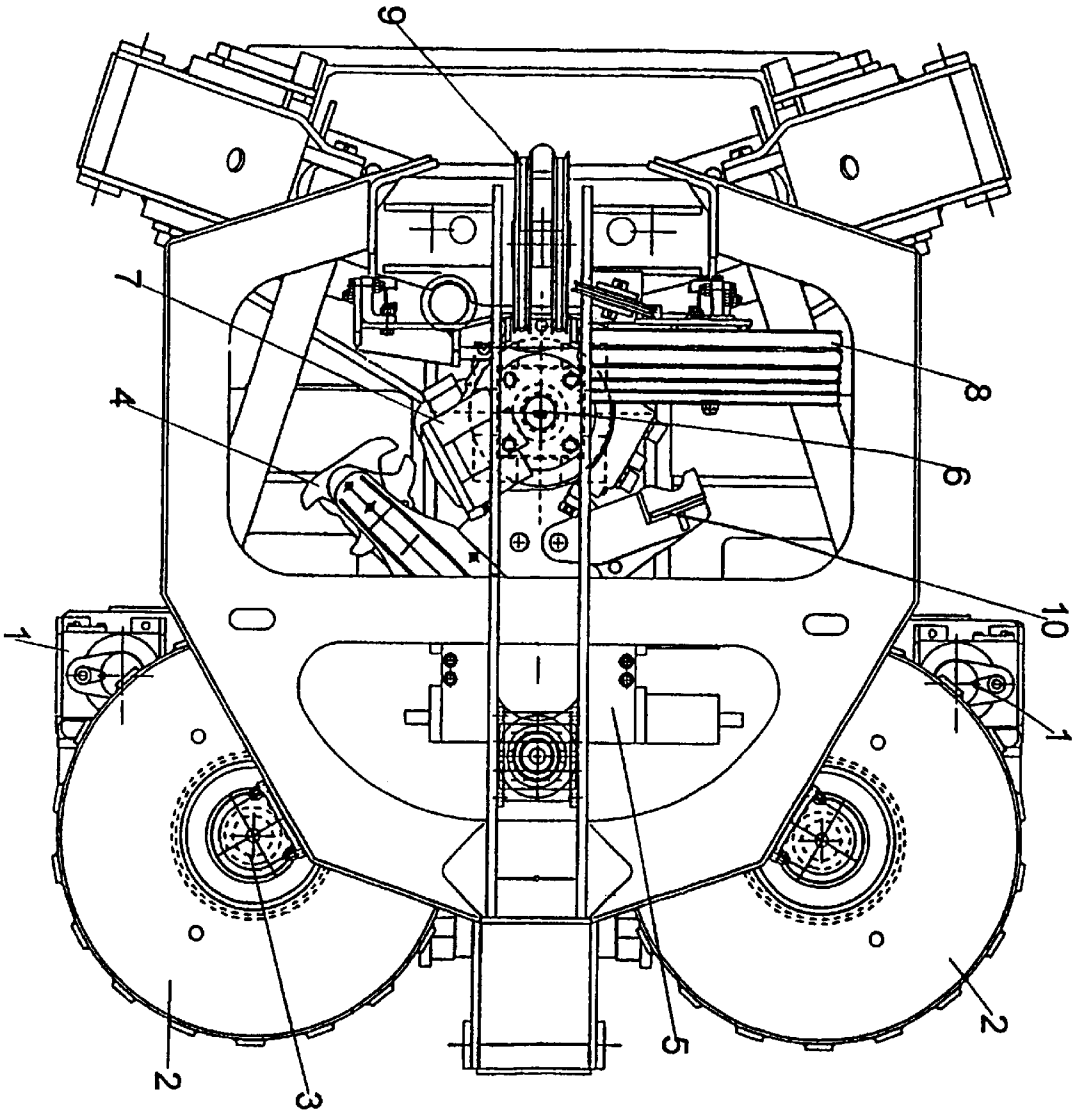
FIG. 5 is a more detailed plan view of the drill of FIG. 2A.

FIG. 5 shows a more detailed plan view of the drill. The Geneva drive pinions 5-1 independently driving the two magazines 5-2 are shown with the magazine top swivel bearings 5-3.

A plan view of the loading arms 5-4 shows the double jaw structure. The loading arm is pivoted by rotary actuator 5-5 to move drilling tools between the magazines and the drill centre line 5-6 as required for the drilling process.

A plan view of the rotary drilling unit 5-7 is visible partly occluded by the top structure. The spooling drum 5-8 holds the hoses and cables that are connected to the rotary drilling unit and is moved up and down at the same time as the rotary drilling unit to keep the hoses and cables organized.

The top sheaves 5-9 are part of the 2:1 cable system on the carriage elevator.

One of the alignment guide arms 5-10 is shown. The other arm is symmetrical with the one shown and on the other side, under the loading arm. They are both operated by hydraulic cylinders to swing into the centre to clamp onto a drill tool in position on the drill centre line.

Figure 6A:
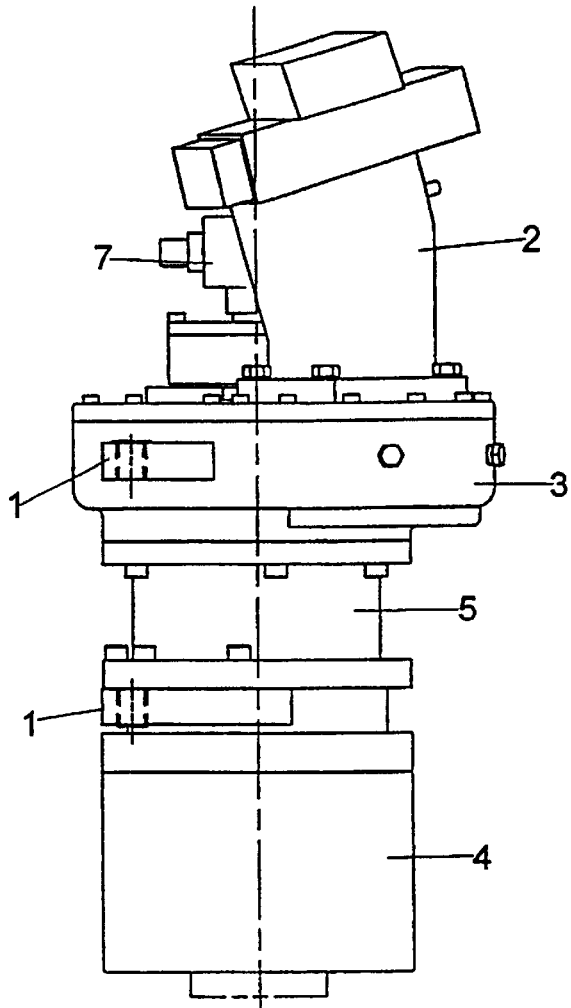
FIG. 6A is a side view of the rotary drilling unit.
Figure 6B:
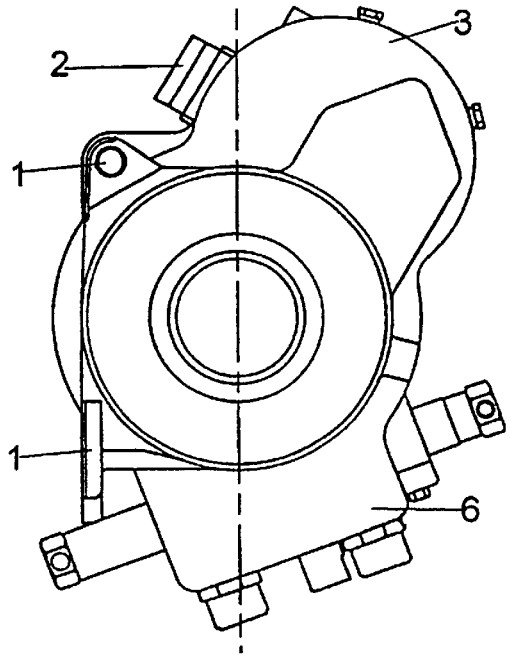
FIG. 6B is a plan view of the rotary drilling unit of FIG. 6A.

FIGS. 6A and 6B show more details of the rotary drilling unit which is mounted to the carriage by means of pins and bolts through lugs 6-1. The drive power is provided by a hydraulic motor 6-2 driving though a gearbox 6-3 which provides both a gear reduction and an off-set drive.

The output of the gearbox drives the rotating chuck 6-4 which is operated hydraulically through a hydraulic slip ring in stationary centre housing 6-5.

A hydraulically operated rack drive system for breaking out drill tool threads is enclosed in housing extension 6-6. This rack system engages the output gear of the gearbox to provide a direct high reverse torque.

The output shaft of the gearbox also protrudes through the top of the gearbox, and is hollow, connecting the top to the inside of the rotating chuck. A rotary swivel coupling 6-7 is mounted on the top of the shaft for water connection to the drill string.

Figure 7:
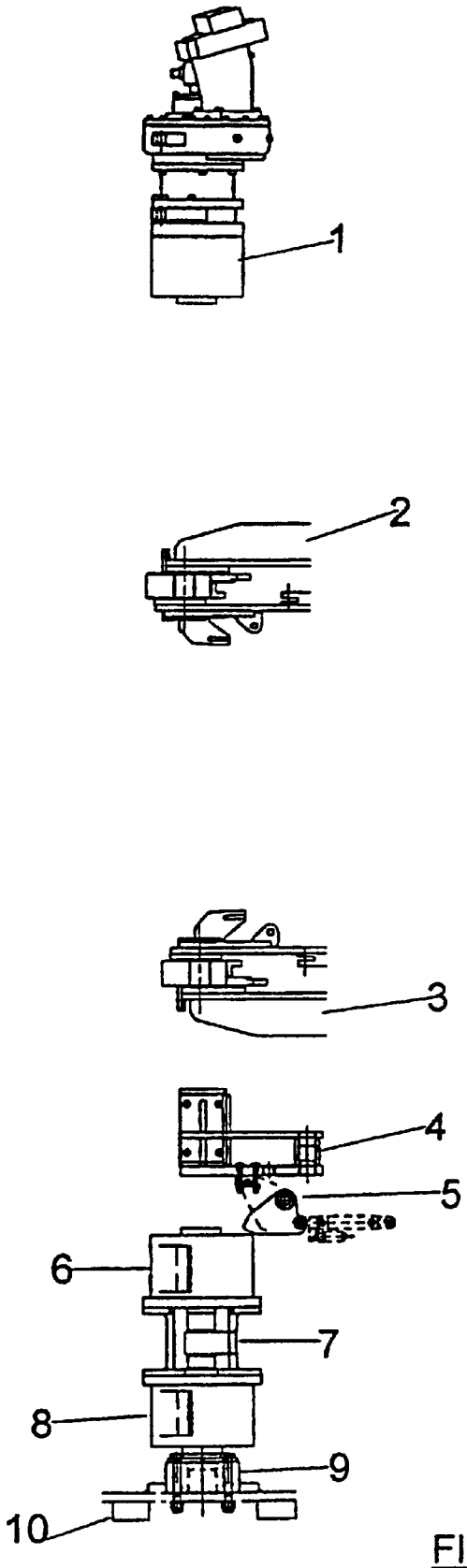
FIG. 7 is a side sequential view of the drilling equipment.

FIG. 7 shows the main components used during the drilling process. 7-1 is the rotary drilling unit just described. The upper and lower loading arms, 7-2 and 7-3 respectively, which will be described in more detail later, fetch tools from the magazines and return them after use. Alignment guide 7-4 and alignment guide spacer 7-5, again described in more detail later, assist in the thread make-up between drill tools.

Rod clamp 7-6 is hydraulically operated and similar in design to the hydraulic chuck on the rotary drilling unit. It is used to hold the drill string while a tool is added or removed from the string. Intermediate guide 7-7 provides location for the drill casing which contributes to the positioning of the drill on the seabed. Casing clamp 7-8 is identical in construction to the rod clamp but is used to clamp the drill casing string. Bottom guide 7-9 also provides location for the casing, in conjunction with the intermediate guide and casing clamp.

The bottom of the drill 7-10 is normally positioned on or near to the seabed by adjustment of the drill legs.

Figure 8:
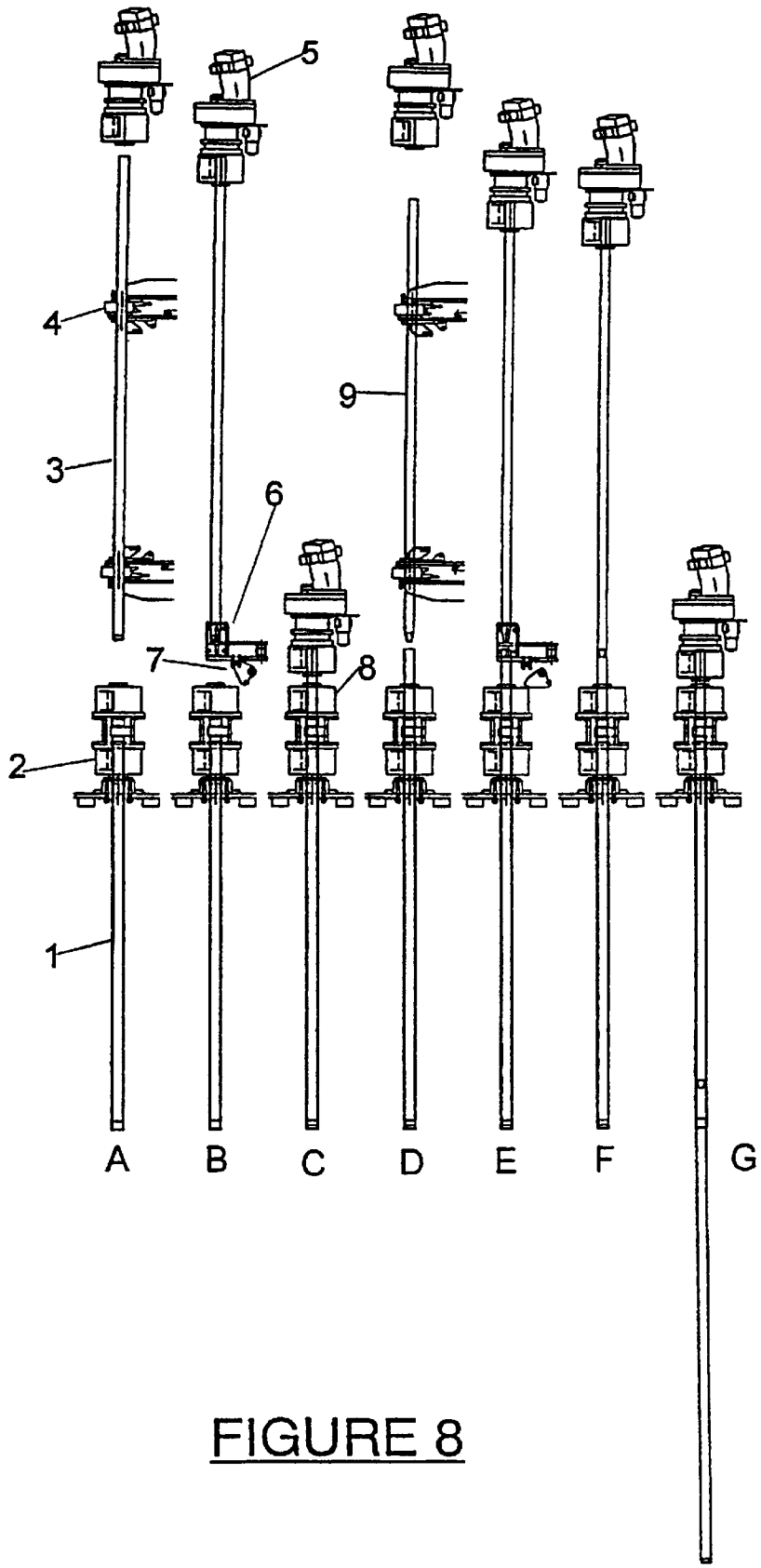
FIG. 8 is a side view of the drilling procedure.

FIG. 8 illustrates a part of a typical coring cycle. Each core sample is taken and stored in a separate core barrel. For each successive sample an empty core barrel is introduced into the hole and lowered down to the previous finish depth by adding the required number of drill rods to the drill string. The sample is then taken and the core barrel withdrawn, by sequentially removing the drill rods, and stored back in the magazine. This process is repeated into the deepening hole until the required maximum sample depth is achieved.

Casings can be installed separately, but in similar manner, as required.

The sequence shown on FIG. 8 starts at step A with a first core sample already taken, and a length of casing 8-1 subsequently installed and held in casing clamp 8-2. A core barrel 8-3 taken from a magazine and presented to the drill centre line by loading arms 8-4.

In step B, the rotary drill unit 8-5 has been lowered and its chuck grabbed the top of the barrel. The alignment guide 8-6 locates the bottom of the barrel. The alignment guide spacer 8-7 is deployed to hold the guide slightly open so that it does not clamp on the barrel, but merely provides a sliding guide. Once the barrel is held, the loading arms are moved out of the way.

As the barrel is lowered into the hole by the rotary drill unit, the alignment guide is withdrawn. Step C shows the barrel lowered to the bottom of the hole where it is clamped by the rod clamp 8-8. The rotary drill unit then retracts to its top position in Step D and a drill rod 8-9 is brought into the centre line by the loading arms.

Step E shows the drill rod held by the chuck of the rotary drill unit at the top and by the alignment guide at the bottom. The alignment guide spacer is retracted so that the alignment guide clamps onto the top of the core barrel to provide guidance for thread make-up.

The rotary drill unit then lowers and rotates to make up the thread between the drill rod and core barrel. The alignment guide then retracts as shown in Step F.

Step G shows the core barrel at its full depth having taken the next sample. This is then withdrawn from the hole by the reverse of the sequence described above and stored back in the magazine.

The next operation would typically be to install a new length of casing to the new depth, followed by another core barrel to the next depth.

Figure 9:
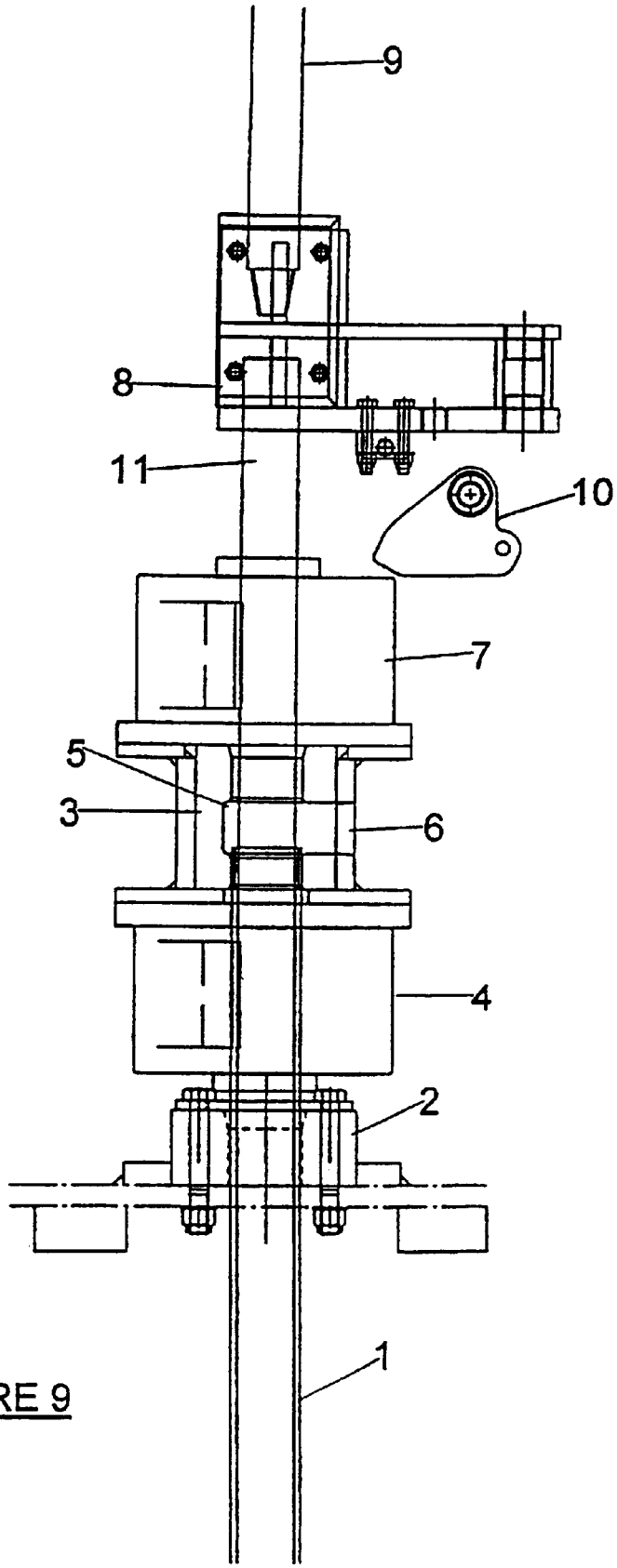
FIG. 9 is an expanded side view of the rod and casing clamp area.

FIG. 9 shows an expanded view of the clamp area in Step E of FIG. 8. The casing 9-1 is supported by the bottom guide 9-2 and intermediate guide 9-3 and is held by casing clamp 9-4.

During diamond core drilling, the rock cuttings from the drilling process normally pass up the inside of the casing and exit at the top of the casing into gallery 9-5 formed in the intermediate guide. The suction of a suitable centrifugal pump is connected to outlet 9-6 to remove the cuttings from the clamp area and discharge them into a pipe running along one of the drill legs.

The rod clamp 9-7 is shown holding a core barrel 9-11 with the alignment guide 9-8 deployed to clamp around the top of the barrel. A drill rod 9-9 is shown ready to engage its thread with a mating thread in the tip of the barrel. The alignment guide spacer 9-10 is shown in retracted position. It is operated by a small hydraulic cylinder, not shown.

One known method of coring is diamond coring using diamond set bits. This equipment is commonly used for rock coring on land and the operation of this device will be well known to those skilled in core drilling.

For operation, the drill has to provide rotation and downward force in a controlled manner so that the diamond bit at the bottom cuts its way into the rock.

A supply of water is provided through the hollow drill rods to the top of the core barrel and discharges with the cuttings, up the outside of the barrel.

This water is supplied by a water pump, driven by a hydraulic motor, mounted on the drill. The delivery from this pump connects with a flexible hose to the rotary drilling unit to accommodate its vertical movement.

Figure 10:
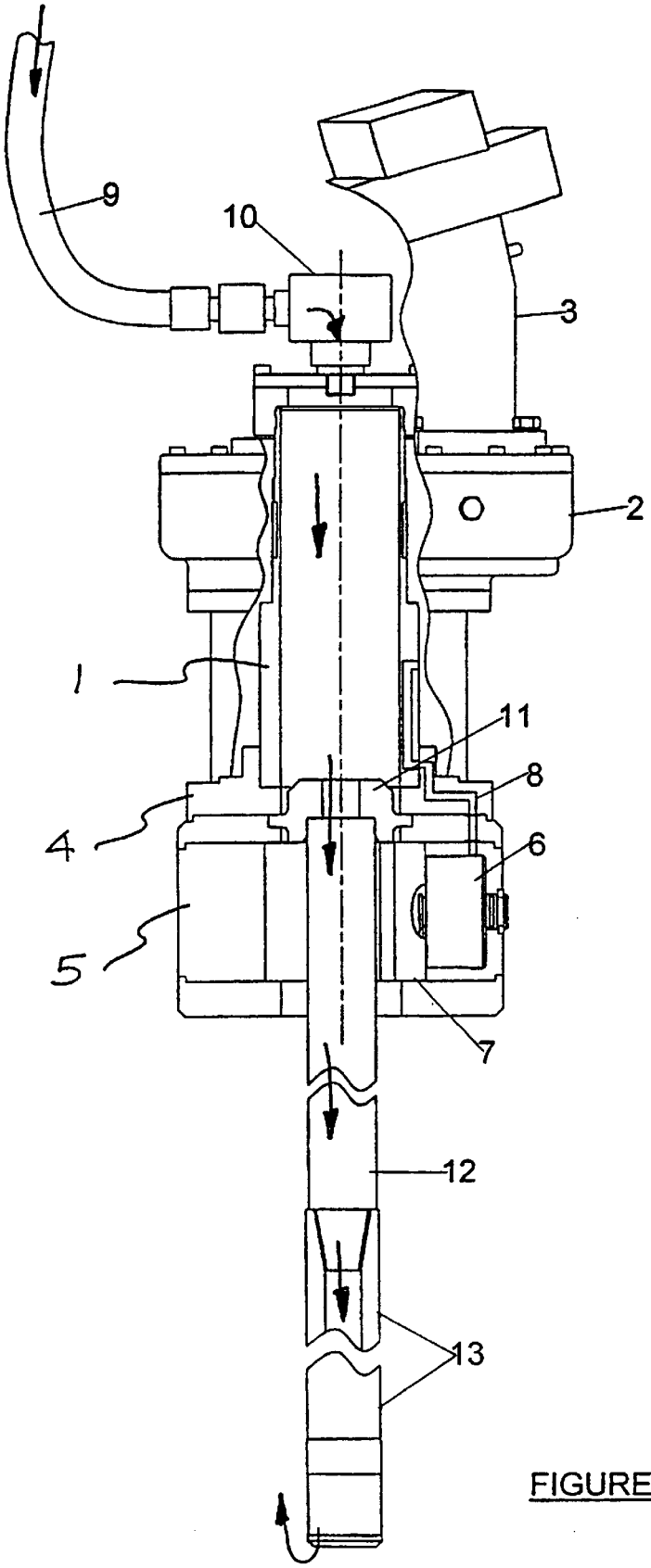
FIG. 10 is a cross-sectional view showing part of the water circuit for rock coring.

FIG. 10 shows a part sectional view of a rotary drill unit. Hollow shaft 10-1 is supported within the housings 10-2 on bearings, not shown, and rotated by hydraulic motor 10-3 through gears, also not shown. Drive plate 104 is attached to the hollow shaft and supports chuck assembly 10-5. One of three chuck cylinders is shown 10-6 with chuck jaw 10-7. The chuck cylinder is connected through conduits 10-8 to a slipring incorporated in the hollow shaft.

The drill water supply is delivered into flexible hose 10-9 through rotary coupling 10-10 into the centre of the hollow shaft, then through seal piece 10-11 which seals against the end of the drill rod 10-12, which has a hole, not shown, through its length. This drill rod may be connected to other drill rods to make up the drill string, depending on the drill depth, or to the core barrel 10-13 as shown.

The core barrel drills a slightly oversize hole so that the water can flow on the outside of the barrel and then past the drill rod and out of the top of the hole.

Another known coring system is piston coring. Much of the seabed is covered with a layer of sedimentary material that is too soft to core successfully using standard diamond coring systems as just described.

Short samples can be achieved using conventional soil sampling techniques such as the Shelby tube, but the friction on the sample acting on the inner walls of the tube quickly builds up to prevent the entry of new material, so that the tube becomes effectively a solid rod and displaces the sediment without any further winning of sample.

This effect is particularly damaging when there are layers of very soft and harder material, as the friction of the harder material prevents any, or at most little, of the soft material entering the tube. The sample in the tube then consists almost entirely of the harder material.

Figure 11:
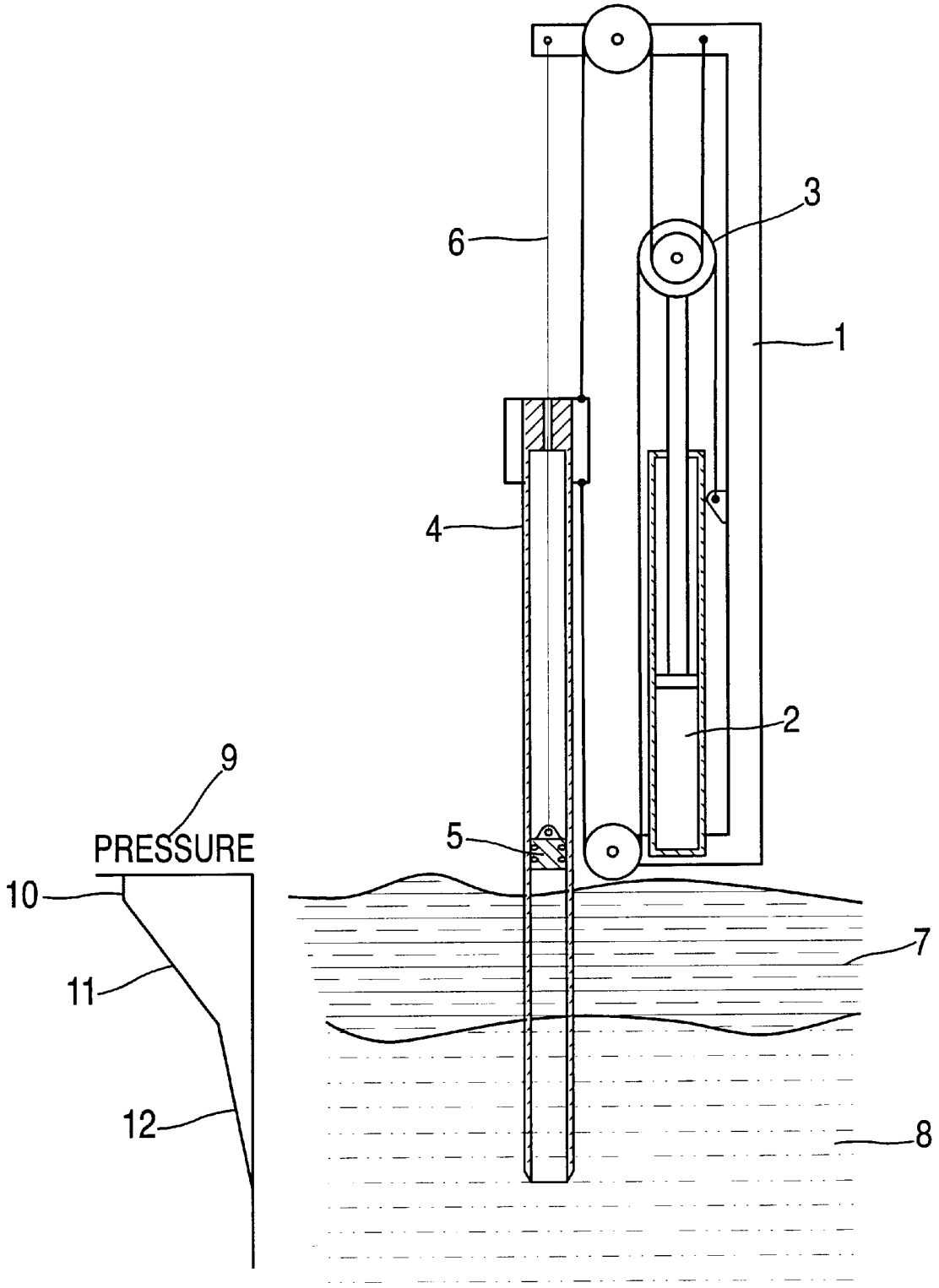
FIG. 11 (PRIOR ART)
FIG. 11 is a schematic representation of the principle of operation of piston coring according to the prior art.

Conventional sampling on the seabed takes advantage of the water pressure at depth to take longer and more representative samples by use of piston coring technology. FIG. 11 shows a schematic of a piston coring system. A drill frame 11-1 is held near the seabed by support means not shown and includes a hydraulic feed cylinder 11-2 and rope and pulley system 11-3, so that extending the feed cylinder causes the core sampling tube 11-4 to be pushed into the seabed. A piston 11-5 is installed inside the sampling tube and includes seals to prevent leakage past the piston.

The piston is supported from the frame by tether rope 11-6, so that, as the tube is pushed into the seabed, the piston is constrained to remain stationary.

If the friction of the material in the tube creates enough force to overcome the hardness of the material entering the bottom of the tube, the material in the barrel will try to move down with the tube. Providing that the material is essentially impervious, this will create a reduced pressure under the tethered piston. The difference in pressure between that at the bottom of the tube and that under the piston is then available as an additional force to overcome the friction of the material in the tube.

The reduced pressure under the piston is self-regulating as it is generated by the friction in the tube and the pressure gradient down the tube is proportional to the friction in each part of the tube. This means that a complete sample of the seabed is obtained, complete with soft and hard layers.

Referring again to FIG. 11, the seabed is shown as two layers, with a high friction layer 11-7, perhaps stiff clayey sand, overlaying a low friction base 11-8 of say mud.

The graph 11-9 shows the distribution of reduced pressure down the inside of the tube. The lowest pressure 11-10 is just under the piston, the pressure gradient 11-11 through the high friction material is steeper than the gradient 11-12 through the low friction material. The pressure at the mouth of the tube is substantially equal to the ambient pressure at that water depth.

This process becomes more effective with increasing water depth because the available reduction in pressure increases. It is essentially ineffective on or near the surface.

It is difficult to apply this method to a drill that has a segmented drill string made up of a variable number of drill rods, depending on penetration depth, because there is no practical way of connecting the tether rope to the piston in the core barrel at the bottom of the drill string.

Figure 12:
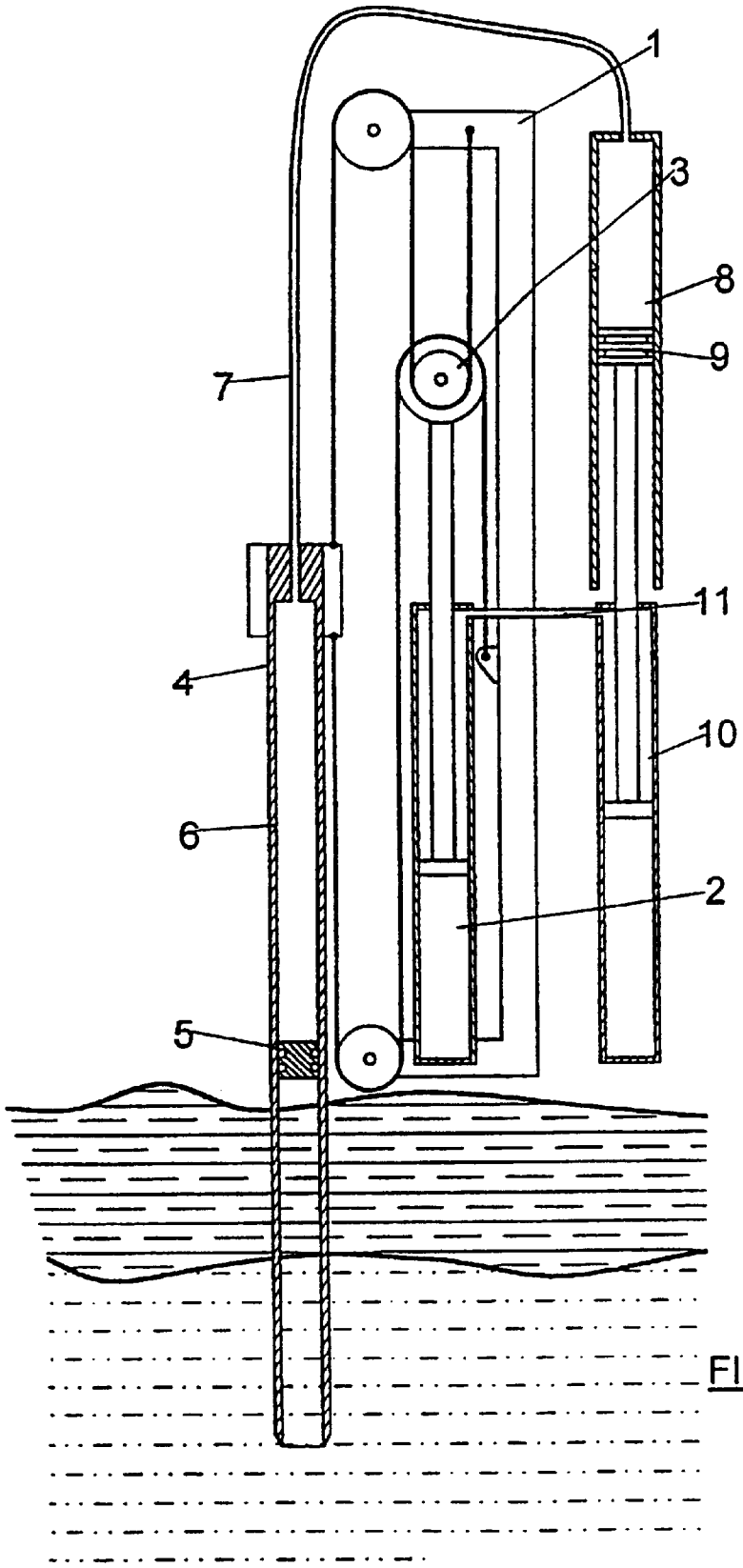
FIG. 12 shows in schematic, a preferred embodiment of a method of piston coring according to the invention.

FIG. 12 shows a schematic of a method of applying the same principles of operation without the use of a mechanical tether for the piston. The drill frame 12-1, hydraulic feed cylinder 12-2, rope pulley system 12-3 and core sampling tube 12-4 remain the same as described with FIG. 11.

In this case the tether rope is not used, but the chamber 12-6 above a floating piston 12-5, being filled with water, is connected by conduit 12-7 to water cylinder 12-8. The piston 12-9 is operated by a second hydraulic cylinder 12-10, called the coring cylinder, which is interconnected to the feed cylinder by connection 12-11.

The water cylinder and coring cylinder are sized so that extension of the feed cylinder to push the core tube into the seabed causes retraction of the coring cylinder, drawing water into the water cylinder so that the floating piston is drawn into the core tube at the same rate as the core tube penetrates the seabed. By this means the floating piston is held a stationary relative to the seabed, thus providing the same method of core sampling as is achieved with the mechanically tethered system.

The floating piston has low friction so that there will be substantially equal pressures above and below the piston. The pressure in conduit 12-7 is thus a direct measure of the frictional resistance of the material being sampled, so that the use of a pressure transducer, for example, provides information on the sediment characteristics.

The same result can be achieved without the floating piston at all with the material in the tube effectively acting as the piston, but the use of a piston is preferred as it minimises disturbance to the water/sediment interface and prevents the sample being inadvertently drawn up into the conduit.

The combination of components described above is called a "hydraulic tether" system as it replaces the conventional mechanical piston tether.

The conduit 12-7 as applied to the seabed drill passes through a number of components as will be described with reference to FIG. 13.

Figure 13:
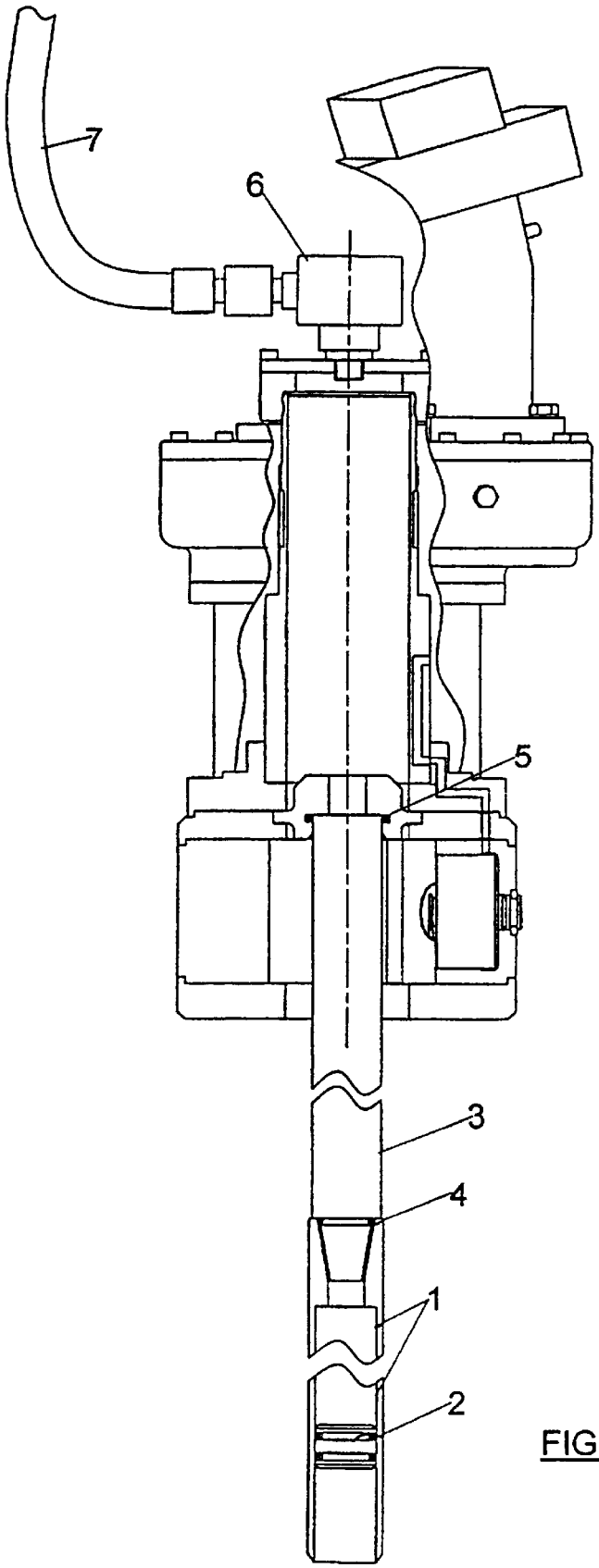
FIG. 13 is a cross-sectional view of the sealed drill string for piston coring according to the invention.

FIG. 13 is similar to FIG. 10 used for rock coring but with some important differences. The rock core barrel is replaced with a piston core barrel 13-1 incorporating a sealed piston 13-2. The connection with the drill rod 13-3 now has a seal 13-4 to ensure a leak free joint with external pressure higher than internal pressure. Any leakage would reduce the effectiveness of the hydraulic tether system. If there is a number of drill rods, there will be similar seals at each join.

Similarly, the top of the drill string is sealed 13-5 in the chuck assembly.

As the drill will be used for both rock drilling and piston coring, the rotary coupling 13-6 has to withstand both moderate internal pressure and potentially higher external pressure., depending on water depth and sediment friction characteristics. Similarly the hose 13-7 has to withstand a high external collapse pressure.

As the drill will be used for rock coring as well as piston coring, the drill water has to be valved to either the drill water pump or the hydraulic tether system, achieved by the use of conventional poppet valves operated by small hydraulic cylinders, not shown.

Figure 14:
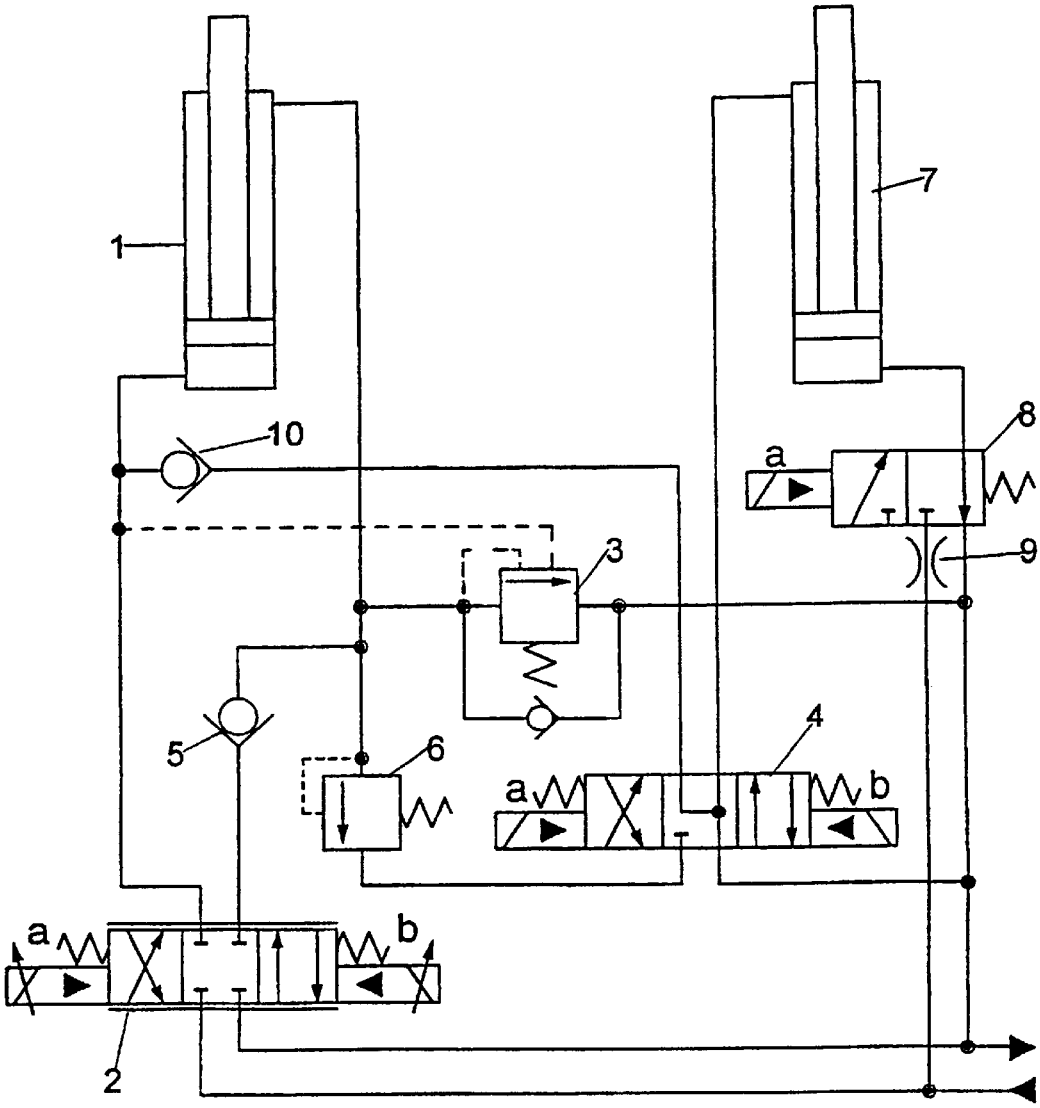
FIG. 14 is a hydraulic circuit used with piston coring according to the invention.

FIG. 14 shows a part of the oil hydraulic circuit illustrating the requirements for engagement of the hydraulic tether system.

In the position shown the feed cylinder 14-1, refer also 12-2, is held stationary by the closed centre of proportional solenoid valve 14-2. If solenoid b of this valve is energised, the feed cylinder will be extended, with the return flow from the rod end directed to return through over centre valve 14-3. The over centre valve acts to hold the weight of the rotary drill unit, carriage and drill string so that the lowering speed is controlled by the oil feed into the feed cylinder. Check valve 14-10 prevents flow back to return though mode selection solenoid valve 14-4 when it is in the neutral position shown.

If solenoid a is energised the feed cylinder is retracted, causing the drill string to be raised.

The mode selection valve provides additional functionality by selecting the destination of the return flow from the rod end as the feed cylinder extends. With solenoid b of the mode selection valve, the return flow is connected back into the feed cylinder to provide a regenerative effect for faster cylinder operation. Check valve 14-5 prevents the return flow passing back through the proportional valve. Counterbalance valve 14-6 acts to hold the weight in the same manner as the over centre valve.

Energising of solenoid a of the mode selection valve directs the return flow from the rod end of the feed cylinder to the coring cylinder 14-7, refer also 12-10, so that the coring cylinder is retracted at a speed proportional to the speed of extension of the feed cylinder, with a ratio depending on their relative piston and rod sizes. The coring cylinder then operates the water cylinder as described with reference to FIG. 12. Over centre valve 14-3 now acts as a pressure relief valve to limit the maximum pressure to the coring cylinder.

Coring reset solenoid valve 14-8 is used to return the coring cylinder to the retract position after the piston coring process. The orifice 14-9 limits the reset speed.

The hydraulic tether system can be used with a range of coring tools with two preferred embodiments described in the following drawings.

Figure 15A:
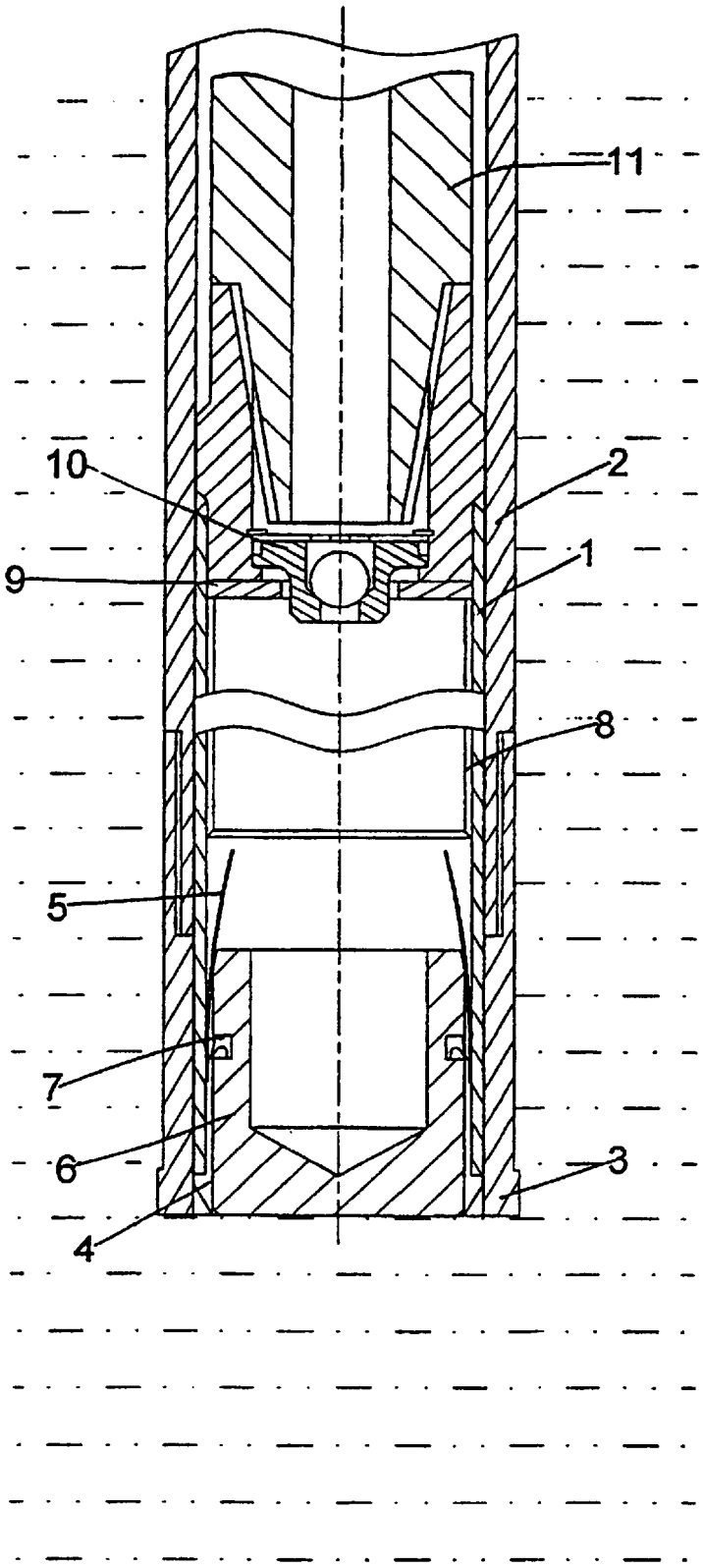
FIGS. 15A to 15F depict the sequential operation of a piston core barrel in accordance with the invention.

FIG. 15A shows a piston core barrel 15-1 in a casing 15-2 ready to take another in a series of samples. The casing has a bit 15-3 that allows it to ream out the hole as it is advanced, described in more detail later. The core barrel has a cutting edge 15-4 incorporating a segment type catcher 15-5 attached to the bottom of core barrel tube by means not shown, but typically a press fit, or small grub screws or rivets. A floating piston 15-6 starts at the bottom of the tube as shown, in this case positioned by the lip of piston seal 15-7 catching on the edge of the top of the cutting edge assembly. It could be positioned by other means such as a spring retaining ring.

A liner 15-8, typically plastic, is fitted to the majority of the length of the barrel. A washer 24-9 is positioned at the top of the liner which is used to assist in extracting the sample from the barrel when the drill is unloaded when back on board ship. After removal of the cutting edge and catcher, the washer is pushed down by a suitably sized rod, which then pushes the sample and liner out of the tube. The sample is normally left in the tube and either cut along its axis to split the sample into longitudinal halves or into shorter lengths for testing and other investigations.

Check valve 15-10, which can be removed for the sample extraction described above, allows water to pass out of the barrel but then acts to prevent the floating piston going back down again.

Drill rod 11 is shown attached to the top of the barrel, ready to push the barrel into the sediment.

In operation, the hydraulic tether system is connected and the barrel pushed down. The tether system holds the floating piston stationary by drawing water out of the barrel through the check valve. As the tube extends down over the piston, the seal engages inside the liner to produce a leak proof seal.

The barrel is pushed down quickly, typically a few seconds for the whole length, because the effectiveness of the hydraulic tether system is dependent on the low porosity of the material being sampled, so that faster operation allows successful sampling of materials with some degree of porosity. Normally the speed of operation is limited by the output of the hydraulic pumps acting on the feed cylinder, but faster operation can be achieved, about one second, by the use of energy stored in a differential hydraulic accumulator.

Figure 15B:
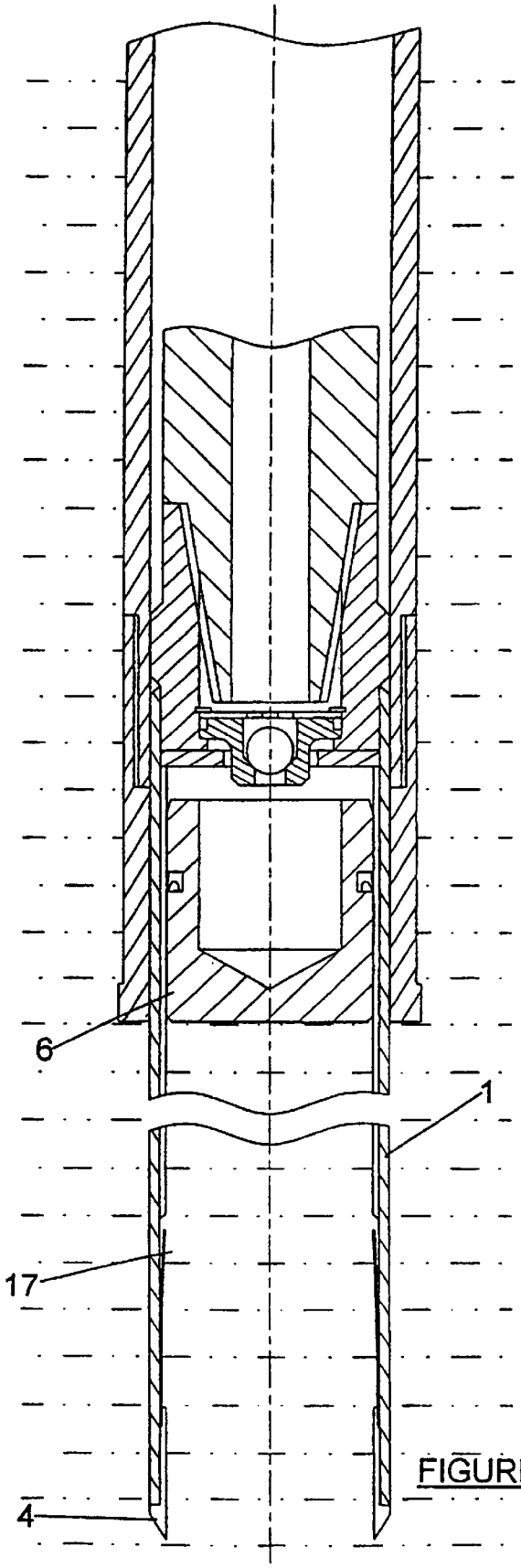

FIG. 15B shows the barrel fully extended, now full of sampled sediment 15-17, with the floating piston 15-6 now close to the top of the barrel in the same position as in FIG. 15A.

The hydraulic tether pressure would be recorded during this process so that the performance can be monitored. The actual pressure change during penetration provides information on the friction characteristics of the material. The pressure should rise progressively during the penetrations with a pressure plateau indicating that the material is too porous for a complete sample to be obtained, that water has flowed through the material to collect under the piston. A sudden rise in pressure may indicate that the piston has reached the end of its stroke for some reason.

Figure 15C:
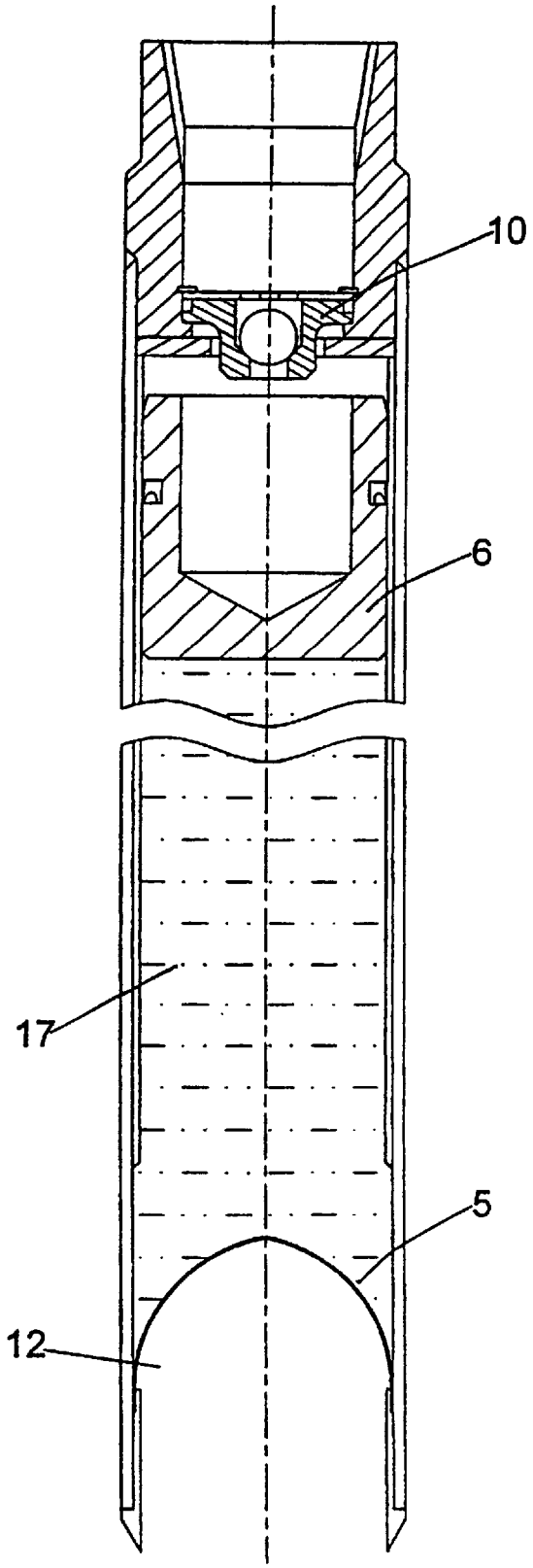

The barrel is now pulled out and stored back on the drill. The sampled sediment 15-17 is held in the barrel, see FIG. 15C, by the combined action of the segmented catcher 15-5 and the check valve 15-10 preventing the piston 15-6 from moving down the tube. The material below the catcher 15-12 may fall out and be lost, or may remain due to its own friction and suction.

Figure 15D:
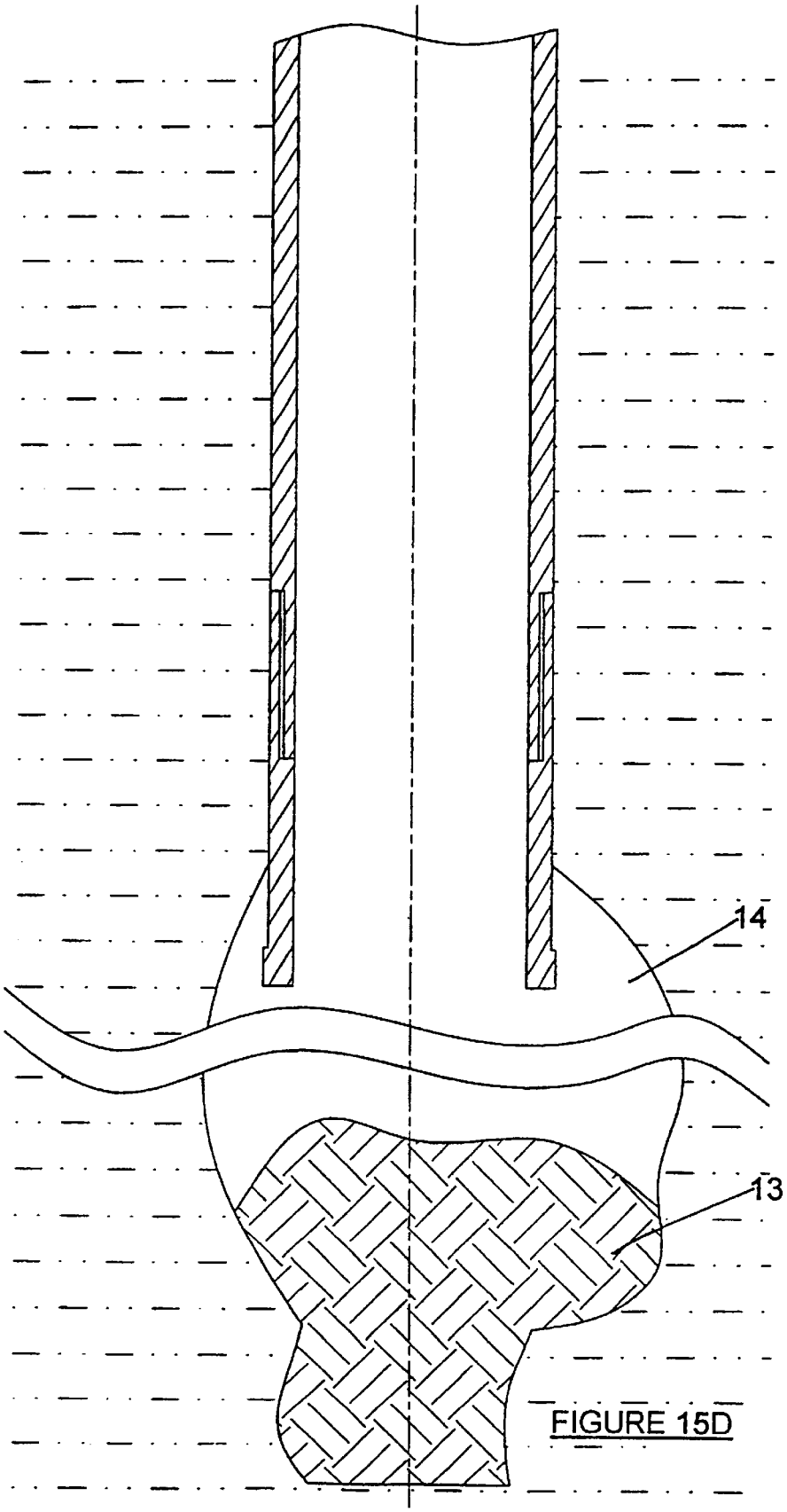

FIG. 15D shows the hole left behind after the barrel is removed. Commonly the hole would slump due to the softness of the material with loose material 15-13 filling the bottom of the hole and a void 15-14 appearing at the top.

Figure 15E:
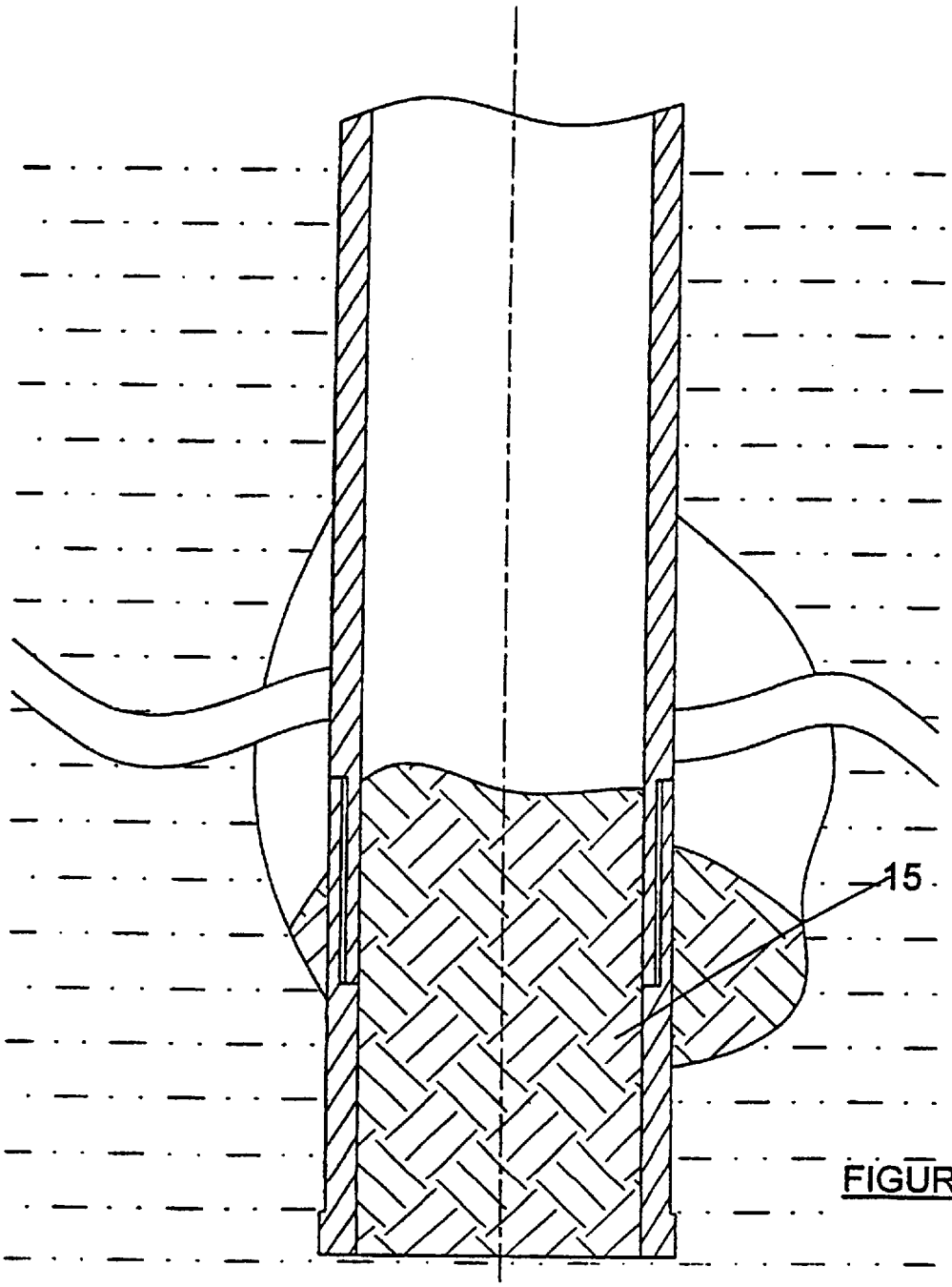

The casing is now advanced to the bottom of the hole, using feed down, rotation and drilling water. Normally this operation will flush the loose material out of the hole, up the outside of the casing with the drill water discharge, but sometimes this will be ineffective so that there is still loose material 15-15 inside the casing as shown on FIG. 15E. This occurrence will usually be apparent by the lack of drill water flow during the process of setting the casing.

Figure 15F:
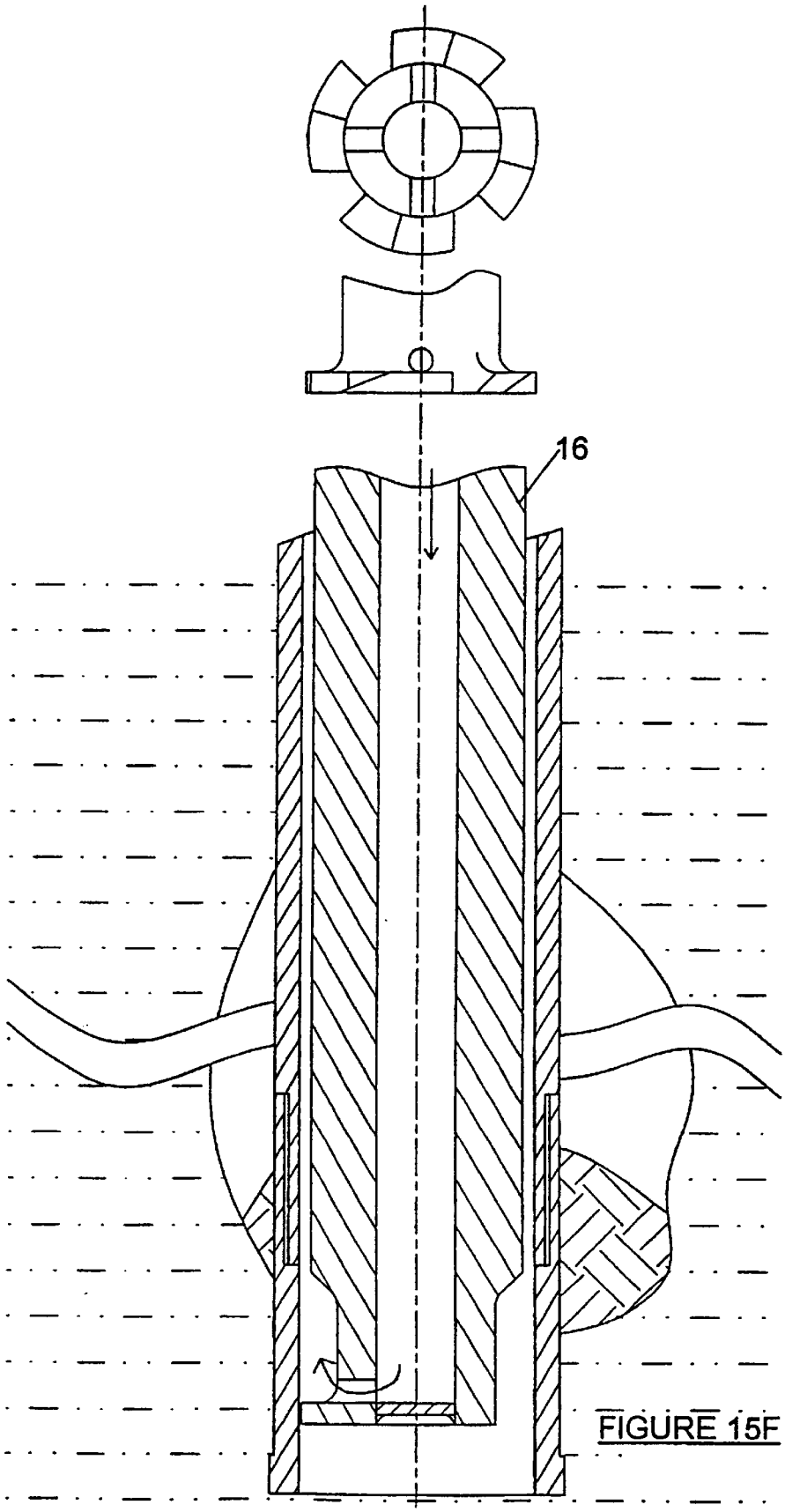

In this case, a cleaning out tool 15-16, FIG. 15F, can be deployed to clean out the hole to the bottom of the casing. The hole is now ready for the next core barrel, starting again as in FIG. 15A.

Figure 16A:
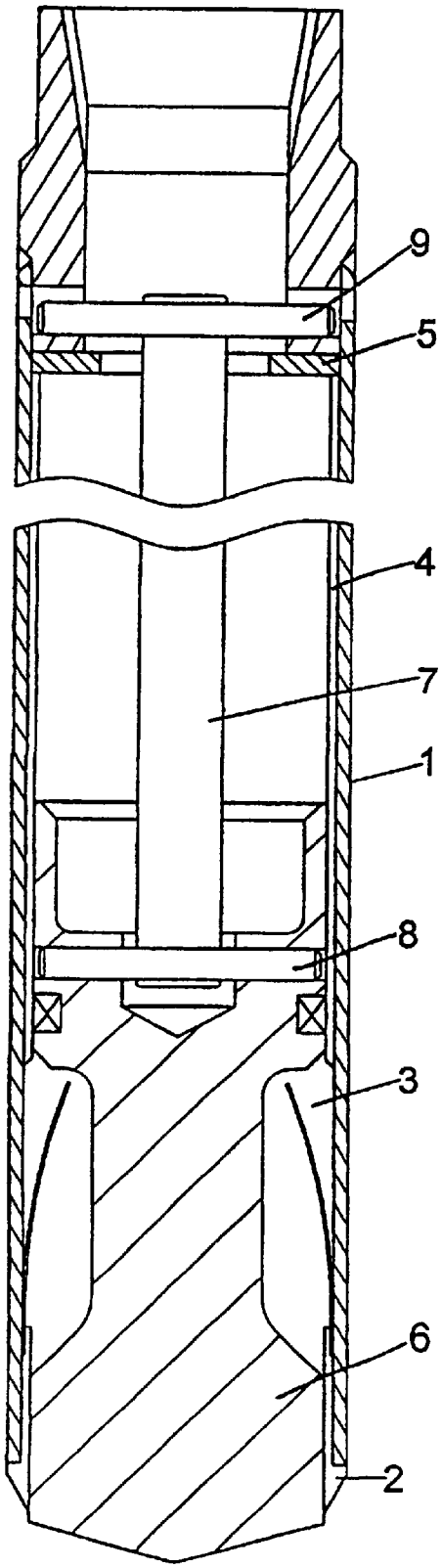
FIG. 16A is a cross-sectional view of the initial position of an alternate form of core barrel in accordance with the invention.
Figure 16B:
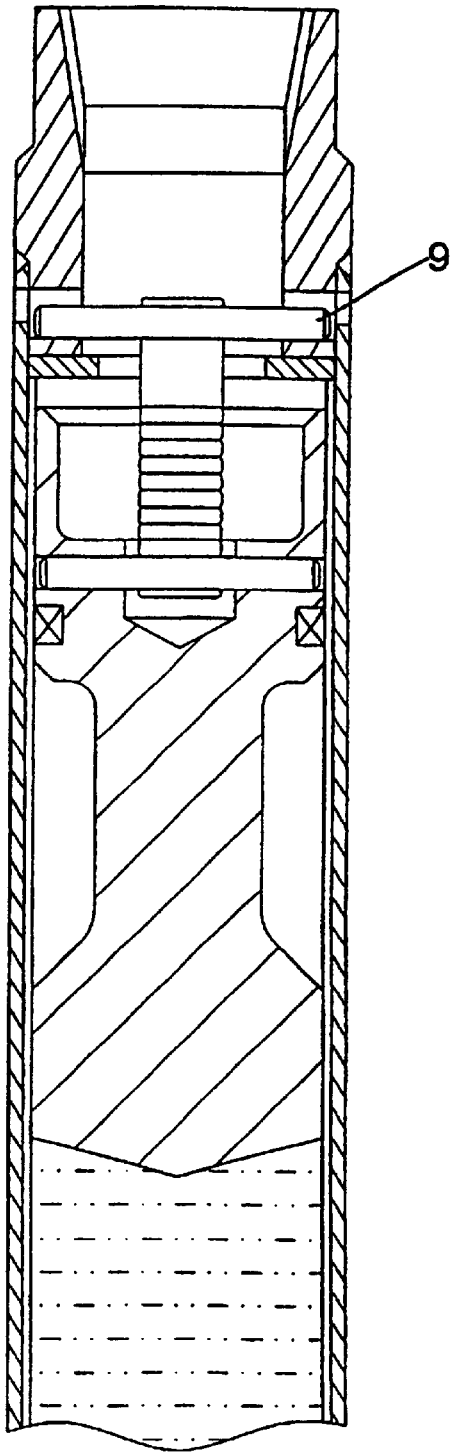
FIG. 16B is a cross-sectional view of the final position of the alternate form of core barrel of FIG. 16A.

FIGS. 16A and 16B show another type of piston core barrel that can used without casing.

The basic construction of the barrel is similar to that of the previous type, with barrel 16-1 cutting edge 16-2, segmented catcher 16-3, liner 16-4 and washer 16-5.

In this case the floating piston 16-6 is held in place by tension strap 16-7, which could be a cable or chain, attached by pins 16-8 and 16-9.

In operation, drill water pressure is applied to extend the piston to the position shown on the left side view. The water in the barrel and sealed drill string is then locked off with suitable valving, not shown, to hold the piston in the extended position as the barrel is pushed to the required sampling depth.

Once the sampling depth is reached, the top of the piston is connected to the hydraulic tether and the barrel extended as with the previous scheme to the position on the right hand view where the piston is near the top of the barrel.

The sample is extracted by first removing the cutting edge and catcher, then disconnecting the strap by removal of pin and pushing out the washer, liner, piston and sample, as before.

Figure 17:
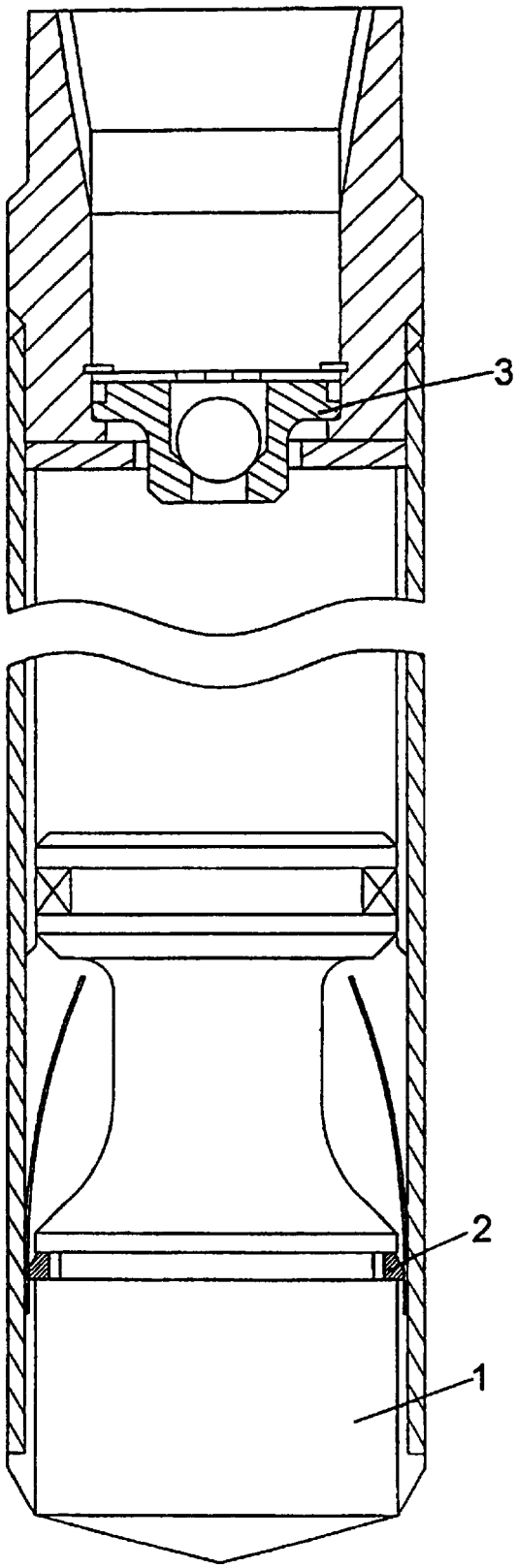
FIG. 17 is a cross-sectional view of the initial position of a further alternate form of core barrel in accordance with the invention.

FIG. 17 shows a slight variation on FIG. 16 where the piston 17-1 is retained in its lower position by the use of a spring retaining ring 17-2 acting against the top surface of the cutting edge. Alternatively, a groove could be provided in the barrel or liner.

This scheme has advantage in that it facilitates the fitting of a check valve 17-3 which will provide improved retention of the sample during retraction and storage, but the check valve removes the possibility of using drill water pressure to push the piston down to its starting point should it be inadvertently moved out of position. The retaining ring can be used without a check valve.

In operation, the barrel is pushed to depth as before, then connected to the hydraulic tether and the barrel advanced. As the barrel passes over the piston, the retaining ring will be pushed back into its groove by the bottom edge of the liner contacting the upper chamfered face of the ring.

The word 'comprising' as used in this description and in the claims does not limit the invention claimed to exclude any variants or additions which are obvious to the person skilled in the art and which do not have a material effect upon the invention.

Modifications and improvements to the invention will be readily apparent to those skilled in the art. Such modifications and improvements are intended to be within the scope of this invention.

The claims defining the invention are as follows:

1. A method of acquiring a core sample of seabed material into a core sampling tube having an upper end, a lower open end and a substantially cylindrical chamber extending therebetween, comprising the steps of:

(a) urging the core sampling tube into the seabed and (b) simultaneously withdrawing fluid from the upper end of the core sampling tube at a rate sufficient to cause the seabed material to be drawn into the core tube at substantially the same rate as the core tube penetrates the seabed.

2. The method of claim 1, wherein step (b) comprises withdrawing the fluid through a conduit means having two ends and connected at one end to the core sampling tube and connected at the other end to a remote means for withdrawing fluid.

3. The method of claim 1, wherein steps (a) and (b) are performed by a combination of remotely coordinated hydraulic fluid power means.

4. The method of claim 3 wherein the coordination of the hydraulic fluid power means comprises the steps of pumping hydraulic fluid into a first hydraulic means to urge the core sampling tube into the seabed and simultaneously pumping hydraulic fluid into a second hydraulic means to withdraw fluid from the upper end of the core sampling tube.

5. The method of claim 1, wherein the core sampling tube further has a piston sealingly engaging and movable within the cylindrical chamber above the seabed material entering the core tube, and in step (b) fluid is withdrawn from above the piston such that the piston is maintained substantially stationary.

6. A core sampling tube for acquiring a core sample of seabed material comprising:

(a) a core barrel having an upper end with a fluid inlet/outlet;

(b) an open lower end; and (c) substantially cylindrical chamber extending therebetween to receive seabed material, wherein in use, the urging of the core sampling tube into the seabed and simultaneous withdrawing of fluid from the upper end of the core sampling tube is at a rate sufficient to cause the seabed material to be drawn into the core tube at substantially the same rate as the core tube penetrates the seabed.

7. The core sampling tube of claim 6 further comprising a piston sealingly engaging the cylindrical chamber and movable axially within the cylindrical chamber in response to fluid flow through the inlet/outlet.

8. The core sampling tube of claim 6 further comprising a remote means for withdrawing fluid.

9. The core sampling tube of claim 8, wherein the remote means is connected to the core sampling tube by an intermediate conduit connectable between the core sampling tube and the remote means.

10. The core sampling tube of claim 9 further comprising an adaptation at the upper end to provide sealing means to permit a leak free connection to the intermediate conduit.

11. A seabed coring system for acquiring a core sample of seabed material, the system comprising:

(a) a core sampling tube according to claim 6;

(b) first hydraulic fluid power means to urge the core sampling tube into the seabed;

(c) second hydraulic fluid power means to withdraw fluid from the core sampling tube above the seabed material; and (d) first conduit means connected between the core sampling tube and the second hydraulic fluid power means;

wherein the first hydraulic fluid power means and the second hydraulic fluid power means are coordinated such that the seabed material will enter the core sampling tube at substantially the same rate as the core tube penetrates the seabed.

12. The seabed coring system according to claim 11 further comprising a piston sealingly engaging and movable within the cylindrical chamber of the core sampling tube above the seabed material entering the core tube.

13. The seabed coring system according to claim 11 wherein the first hydraulic fluid power means comprises a substantially cylindrical chamber, a piston sealingly engaging the cylindrical chamber and movable axially within the cylindrical chamber to define a first chamber and a second chamber, and a piston rod connected to the piston and extending through and from the second chamber so that a selective application of hydraulic pressure to the first chamber will urge the core sampling tube into the seabed.

14. The seabed coring system according to claim 11 wherein the second hydraulic fluid power means comprises:

(a) a first sub hydraulic means including a substantially cylindrical chamber, a piston sealingly engaging the cylindrical chamber and movable axially within the cylindrical chamber to define a third chamber and a fourth chamber, a piston rod connected to the piston at one end thereof and extending through the fourth chamber.

(b) a second sub hydraulic means comprising a substantially cylindrical chamber, a piston sealingly engaging the cylindrical chamber and movable axially within the cylindrical chamber to define a fifth chamber, the piston rod of the first sub hydraulic means having its other end connected to the piston; and (c) second conduit means connected between the second chamber of the first hydraulic means and the fourth chamber of the first sub hydraulic means, wherein, as the core sampling tube is urged into the seabed by the first hydraulic fluid power means, hydraulic fluid is passed from the second chamber of the first hydraulic fluid power means into the fourth chamber of the first sub hydraulic means via the second conduit means to move the piston therein which in turn draws the piston of the second sub hydraulic means away from the first conduit means to cause the withdrawal of fluid from the core sampling tube.

15. The seabed coring system according to claim 14 wherein the first conduit means consists in part of at least one hose with high collapse capability.

16. The seabed coring system according to claim 14 wherein the first conduit means consists in part of at least one drill rod with sealing means to provide a leak free joint between the drill rod and any preceding drill rod.

* * * * *